US009976317B2

(12) United States Patent
Agha Beigi et al.

(10) Patent No.: US 9,976,317 B2
(45) Date of Patent: May 22, 2018

(54) SYSTEM FOR MITIGATING THE EFFECTS OF A SEISMIC EVENT

(71) Applicant: THE GOVERNING COUNCIL OF THE UNIVERSITY OF TORONTO, Toronto (CA)

(72) Inventors: Hossein Agha Beigi, Toronto (CA); Constantin Christopoulos, Toronto (CA); Timothy John Sullivan, Pavia (IT)

(73) Assignee: THE GOVERNING COUNCIL OF THE UNIVERSITY OF TORONTO, Toronto (CA)

( * ) Notice: Subject to any disclaimer, the term of this patent is extended or adjusted under 35 U.S.C. 154(b) by 0 days. days.

(21) Appl. No.: 15/100,333

(22) PCT Filed: Dec. 2, 2014

(86) PCT No.: PCT/CA2014/051154

§ 371 (c)(1),
(2) Date: May 30, 2016

(87) PCT Pub. No.: WO2015/081431

PCT Pub. Date: Jun. 11, 2015

(65) Prior Publication Data

US 2016/0298352 A1 Oct. 13, 2016

Related U.S. Application Data

(60) Provisional application No. 61/910,474, filed on Dec. 2, 2013.

(51) Int. Cl.
*E04H 9/02* (2006.01)
*E02D 27/34* (2006.01)
(Continued)

(52) U.S. Cl.
CPC ..... *E04H 9/027* (2013.01); *E02D 27/34* (2013.01); *E04B 1/98* (2013.01); *E04H 9/021* (2013.01);
(Continued)

(58) Field of Classification Search
CPC ..... E04H 9/027; E04H 9/025; E04H 9/024; E04H 9/021; E04H 9/028; E04G 23/0218; E02D 27/34; E04B 1/98; E04C 2003/026
See application file for complete search history.

(56) References Cited

U.S. PATENT DOCUMENTS 2,053,226 A * 9/1936 Ruge ..... E04H 9/02 52/113
3,418,768 A * 12/1968 Cardan ..... E04H 9/02 188/312
(Continued)

*Primary Examiner* — Andrew J Triggs
(74) *Attorney, Agent, or Firm* — Elan IP Inc.

(57) ABSTRACT

A building structure having one or more of stories and including at least two columns supporting a first of the stories; where at least one of the columns is supported by at least one brace having a first portion and a second portion. The at least one brace has a first configuration in which the first portion is freely moveable with respect to the second portion such that a gap is formed in the brace preventing the transmission of force axially along the brace, and a second configuration in which the gap is closed by the first portion and the second portion being in contact to permit the transmission of forces axially along the brace. The second configuration occurs when the at least one column undergoes a level of deformation sufficient to force the gap to be closed.

26 Claims, 29 Drawing Sheets

(51) Int. Cl.
*E04B 1/98* (2006.01)
*E04C 3/02* (2006.01)
*E04G 23/02* (2006.01)

(52) U.S. Cl.
CPC ..... *E04H 9/028* (2013.01); *E04C 2003/026* (2013.01); *E04G 23/0218* (2013.01); *E04H 9/024* (2013.01); *E04H 9/025* (2013.01)

(56) References Cited

U.S. PATENT DOCUMENTS 5,462,141 A * 10/1995 Taylor ..... E04H 9/02 188/280
5,829,556 A * 11/1998 Domange ..... E04H 9/021 188/268
6,212,830 B1 4/2001 Mackarvich
7,188,452 B2 * 3/2007 Sridhara ..... E04H 9/02 188/266
8,053,068 B2 * 11/2011 Fanucci ..... F16F 15/04 428/292.1
8,291,650 B2 * 10/2012 Vreeland ..... E04H 9/021 248/562
2001/0005961 A1 * 7/2001 Fukuta ..... B65G 1/02 52/167.3
2009/0126288 A1 * 5/2009 Fanucci ..... F16F 15/04 52/167.1
2009/0152430 A1 * 6/2009 Watanabe ..... E04H 9/02 248/354.1
2010/0011681 A1 * 1/2010 Chiang ..... E04H 9/02 52/167.2
2012/0038091 A1 * 2/2012 Tagawa ..... E04H 9/021 267/136
2014/0305048 A1 * 10/2014 Ishii ..... E04H 9/021 52/167.1
2015/0233113 A1 * 8/2015 Ueno ..... E04B 1/98 52/167.1
2016/0298352 A1 * 10/2016 Agha Beigi ..... E04H 9/021

* cited by examiner

SYSTEM FOR MITIGATING THE EFFECTS OF A SEISMIC EVENT

RELATED APPLICATIONS

This application claims priority to U.S. Provisional Application No. 61/910,474 filed Dec. 2, 2013; the contents of which are herein expressly incorporated by reference in their entirety.

FIELD OF THE INVENTION

The invention relates generally to building systems for mitigating the effects of a seismic event, and more particularly to a system for mitigating the effects of a seismic event in a building having a soft storey configuration.

BACKGROUND OF THE INVENTION

Over the past two centuries, buildings with soft storey configurations have been widely constructed all over the world. Broadly, a soft storey building is a building having one or more floors with windows, wide doors, large unobstructed commercial spaces, or other openings in places where a shear wall, or other structural support, would normally be, or where a shear wall, or other structural support, is positioned on other floors above the soft storey, such that the soft storey has significantly lower stiffness and/or strength than the storeys above it. Providing space for parking, retail, storefront windows, shopping areas, and lobbies at the first floor of multi storey buildings are the architectural and social advantages of such buildings as is shown in FIG. 1. Many older buildings are already in existence with this, or similar, configurations. These soft-storey buildings are known to have an extremely poor seismic performance with a propensity for collapse at the first floor, or first few floors which define the soft storeys, and are considered as one of the most vulnerable building typologies commonly found in highly populated urban areas.

Since earthquake records have been recorded, it is estimated that over 8.5 million deaths and almost $2.1 trillion in damage have been reported all around the world. Considering the high contribution of soft storey buildings in the loss of life and money, it has been estimated that soft storey buildings were responsible for a few million fatalities and several billions of dollars of losses. For example, almost two thirds of units that were uninhabitable after the Northridge earthquake, just outside of Los Angeles in 1994, and a high percentage of the death toll were attributed to buildings having a soft storey. These problems with soft storey buildings are widely documented, and well known in the art.

Recently, the art has evolved to the development of more modern design procedures and codes that are intended to avoid column side-sway responses that lead to soft storey response that ultimately renders the building unusable. Measures have been introduced in building codes to address this problem by ensuring that new buildings possess relatively uniform strength and stiffness over the building height. For existing buildings with soft storeys, legislation may require the assessment and retrofit of the structure, and typical retrofit efforts will typically increase the strength and stiffness of the soft storey. However, this does not necessarily reduce the expected total damage and financial losses in the entire building, as some degree of side-swaying still occurs. In addition, traditional retrofitting approaches, such as added reinforced concrete walls or steel braces, not only pose several obstacles to the architectural functionality of these structures, but also greatly increase the design loads that must be accommodated in the retrofitted building. Most, if not all, of these retrofitting approaches of the prior art include substantial modifications to the building structure, often times restricting the use of the soft storey prior to the retrofit, shown schematically in FIG. 2. In addition, many retrofits are cost-prohibitive and fundamentally alter the architecture of the building or the nature of the soft storey itself.

There is accordingly a need in the art of an alternate solution to mitigating the effects of seismic events on a building structure having at least one soft storey.

SUMMARY OF THE INVENTION

According to one embodiment of the invention, there is provided a building structure having at least one storey and including at least one column; at least one brace attached at one end to one side of at least one of the columns and at a second end to a fixed foundation surface; the brace attached to the at least one column at an incline; the at least one brace having a first portion and a second portion; wherein the at least one brace has a first configuration in which the first portion is freely moveable with respect to the second portion such that a gap is formed in the brace preventing the transmission of force axially along the brace, and a second configuration in which the gap is closed by the first portion and the second portion being in contact to permit the transmission of forces axially along the brace; wherein the second configuration occurs when the at least one column undergoes a level of deformation sufficient to force the gap to be closed.

In one aspect of this embodiment, the second portion comprises a tubular shape member and the first portion is sized and otherwise dimensioned to be slidable within the tubular shape member.

In another aspect of this embodiment, the second portion further comprises a stop portion upon which the first portion bears when the gap is closed.

In another aspect of this embodiment, the stop portion is formed by a reduced cross-sectional dimension of the tubular member.

In another aspect of this embodiment, the at least one brace is connected at the one end directly to the at least one column.

In another aspect of this embodiment, the at least one brace is connected to a beam at a position proximate to the at least one column.

In another aspect of this embodiment, the at least one brace is attached to the column and to the fixed ground by pin joints.

In another aspect of this embodiment, the at least one brace is attached to the column using a bracket having a first end connected to the column and a second end offset from the column; the at least one brace attached to the second end with a pin joint.

In another aspect of this embodiment, one of the first and second portions includes an adjustment means for adjusting the length of one of the first and second portions.

In another aspect of this embodiment, the adjustment means comprises an axial length adjustment screw.

In another aspect of this embodiment, the at least one column comprises two outer columns.

In another aspect of this embodiment, the at least one brace comprises two braces supporting each of the columns; the two braces positioned on opposite sides of the columns.

In another aspect of this embodiment, the at least one brace comprises one brace supporting each of the columns and two braces supporting each of the at least one internal columns.

In another aspect of this embodiment, there is provided a supplementary damping system for damping vibrations in the building structure.

In another aspect of this embodiment, the building is configured as a soft-storey structure.

According to a second embodiment of the invention, there is provided a brace for use in supporting at least one column in a soft storey building structure as the column undergoes deformation following a seismic event; the building structure having a one or more stories supported by at least one column; the brace having a first portion and a second portion; wherein the brace has a first configuration in which the first portion is freely moveable with respect to the second portion such that a gap is formed in the brace preventing the transmission of force axially along the brace, and a second configuration in which the gap is closed by the first portion and the second portion being in contact to permit the transmission of forces axially along the brace.

In one aspect of the second embodiment, the second portion comprises a tubular member and the first portion is sized and otherwise dimensioned to be slidable within the tubular member.

In one aspect of the second embodiment, the second portion further comprises a stop portion upon which the first portion bears when the gap is closed.

In one aspect of the second embodiment, the stop portion is formed by a reduced cross-sectional dimension of the tubular member.

In one aspect of the second embodiment, one of the first and second portions includes an adjustment means for adjusting the length of one of the first and second portions.

In one aspect of the second embodiment, the adjustment means comprises an axial length adjustment screw.

In a third embodiment of the invention, there is provided a building structure having at least one storey and including at least one column; at least one brace attached at one end to one side of at least one of the columns; the brace attached to the at least one column at an incline; wherein the at least one brace has a first configuration in which a gap is formed by the brace preventing the transmission of force axially along the brace, and a second configuration in which the gap is closed permit the transmission of forces axially along the brace; wherein the second configuration occurs when the at least one column undergoes a level of deformation sufficient to force the gap to be closed.

In one aspect of the third embodiment, there is further provided a disc-shaped element connected perpendicularly to another end of the brace such that the disc-shaped element is positioned at a non-orthogonal angle to ground when the at least one brace is in the first configuration and the disc-shaped element is positioned substantially flat on the ground when the at least one brace is in the second configuration.

In another aspect, there is further provided a stop element positioned between the at least one column and the at least one brace such that the disc-shaped element bears against the stop element in the first configuration.

In another aspect, there is further provided a spherical element positioned on each face of the at least one column and a ring member located around the at least one column, such that an inner surface of the ring member is spaced from the spherical elements in the first configuration; the at least one brace connected at another end to the ring member; wherein each of the at least one braces are connected via a pin joint to the ring member; such that the ring member moves horizontally towards one of the spherical elements and bears against the one of the spherical elements in the second configuration.

In another aspect, there is further provided a ring member located around the at least one column, such that an inner surface of the ring member is spaced from the column; a stop member positioned axially away from an outer surface of the ring member such that the gap is formed between the outer surface of the ring member and an inner surface of the stop member in the first configuration; the at least one brace connected at another end to the ring member; wherein each of the at least one braces are connected via a pin joint to the ring member; such that the ring member moves towards one of the stop members and bears against the one of the stop members in the second configuration.

DETAILED DESCRIPTION OF THE EMBODIMENT

Figure 1:
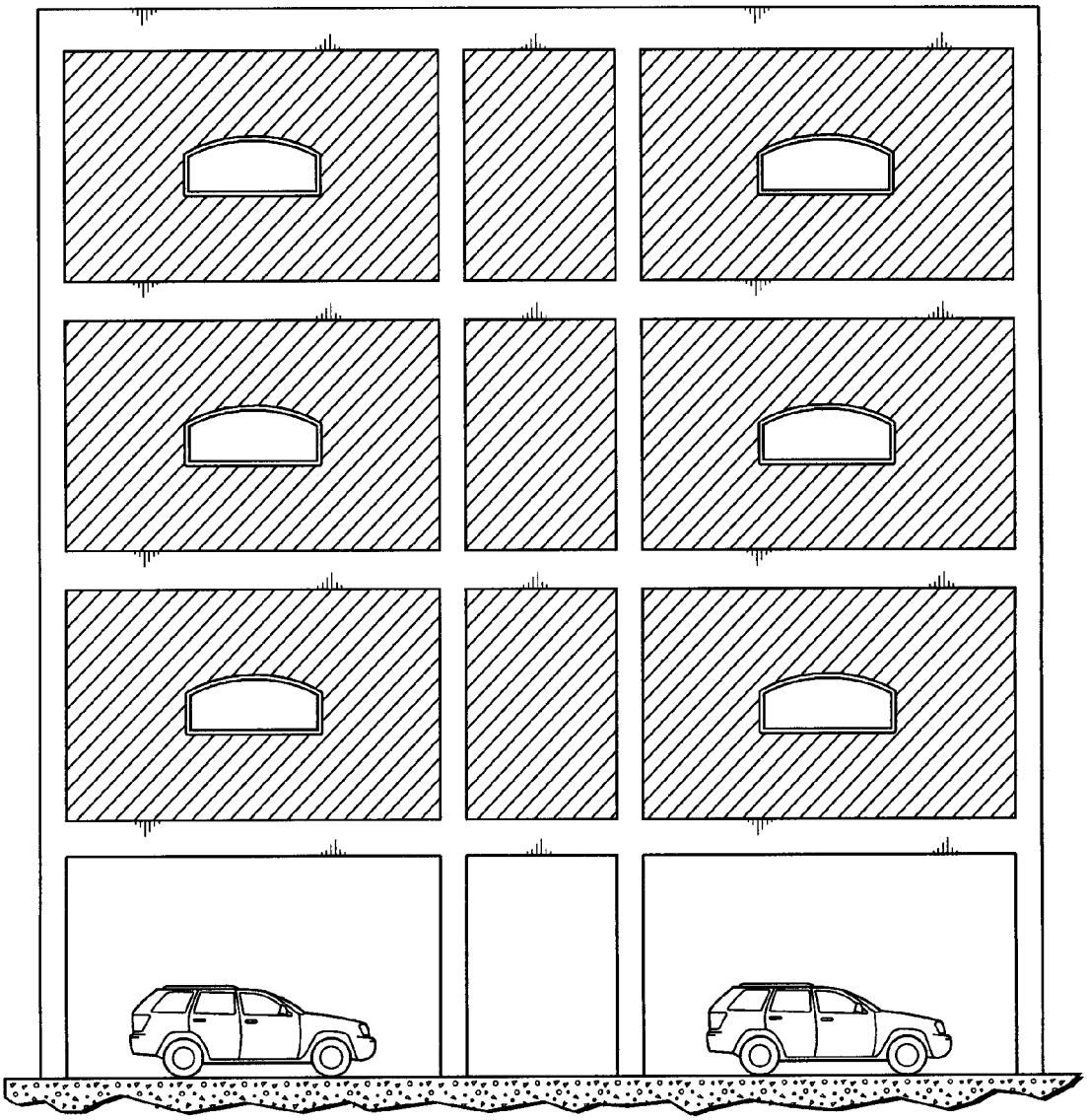
FIG. 1 is an illustration of existing soft storey building arrangements.
Figure 2:
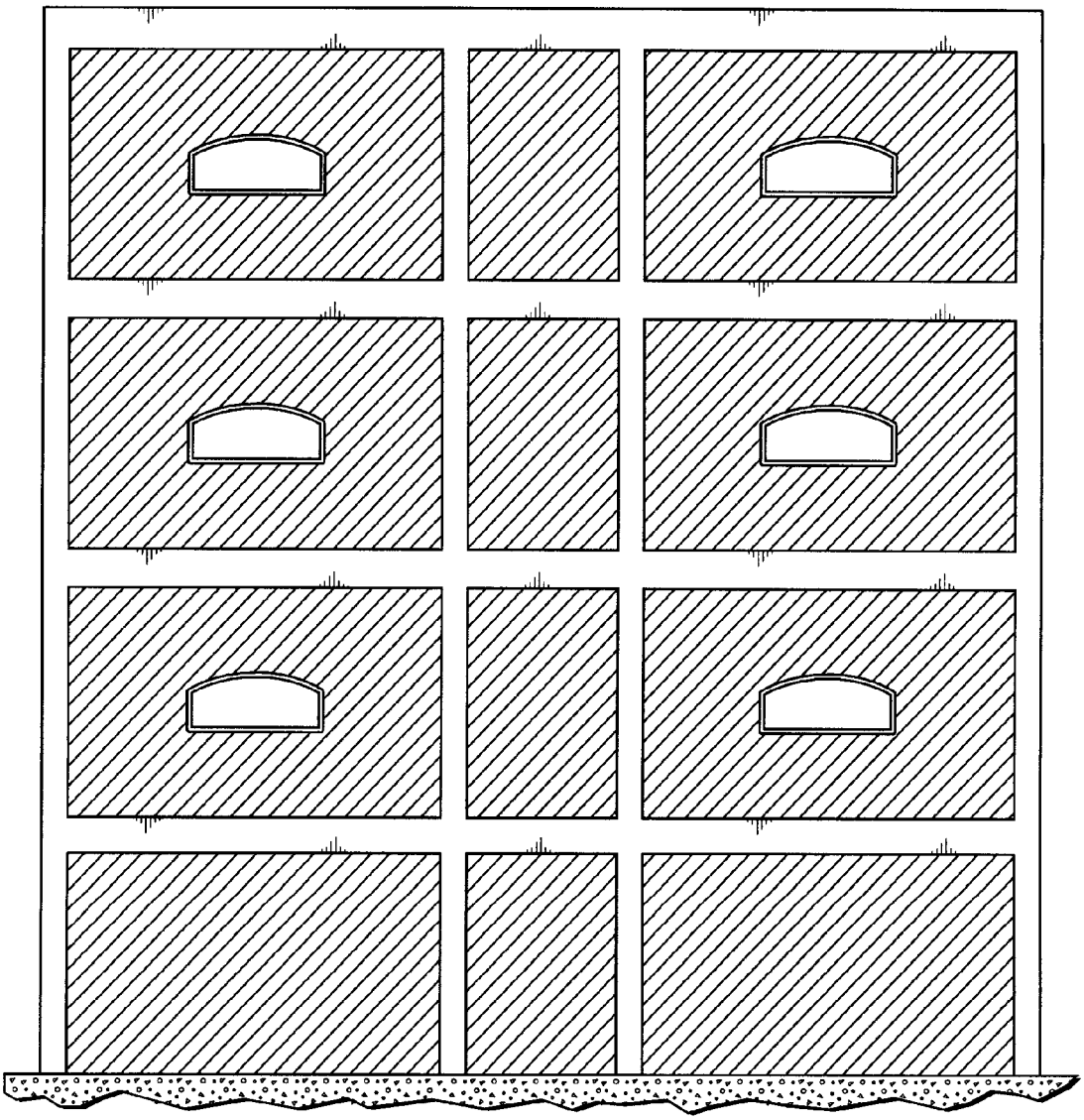
FIG. 2 is an illustration of a prior art retrofit to a building of FIG. 1 in order to mitigate the effects of a seismic event.
Figure 3:
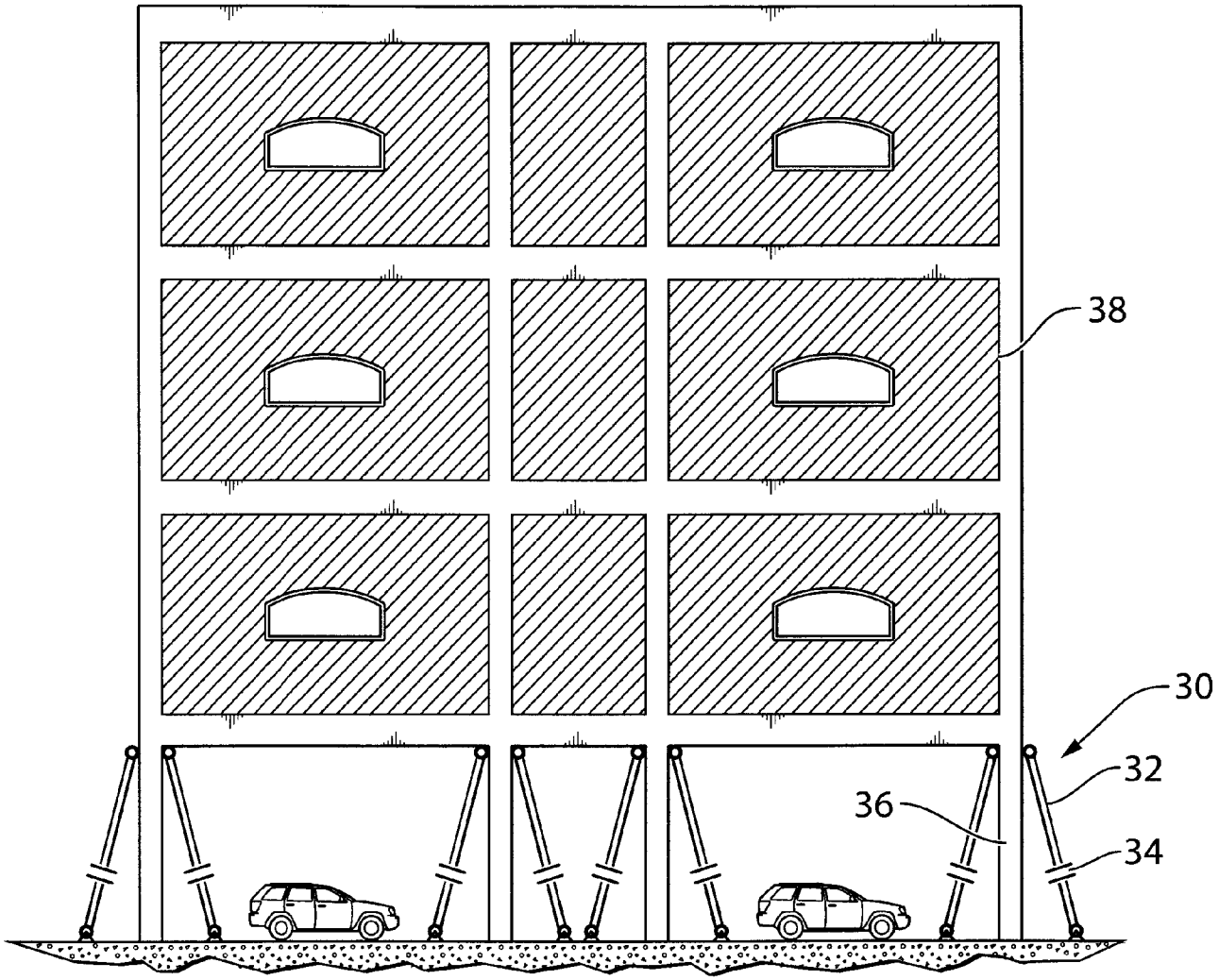
FIG. 3 schematically illustrates a gapped-inclined brace (GIB) element applied to a soft storey building.

Embodiments of the invention provide for a mechanical device that allows seismic deformations to concentrate at the single level at which the mechanical device is operating, while protecting the rest of the structure that is located above. The term single level is used broadly to define one or more building storeys configured as soft storeys. These are typically contiguous storeys at the bottom of the building. While particular details of implementation, design and application will be described in detail below, the device operates to increase the displacement capacity and reduce residual deformations at the first level of soft storey buildings. Generally, the invention provides for a brace element connected to existing columns of a building on one end and to ground or to a foundation surface on the other end. The brace element is positioned at an incline so as to have both vertical and horizontal components of force exerted onto it by movement of the columns in the building. However, the vertical component is intended to be significantly larger than the horizontal component so that when activated, the brace pushes the column upwards. Incorporated into the brace is a means for providing relative movement of one end of the brace with respect to the other end of the brace, referred to herein as a gap element. Cumulatively, the device or system is herein referred to as a gapped-inclined brace (GIB) system. FIG. 3 schematically illustrates this arrangement.

The gapped-inclined brace (GIB) 30 consists of a brace 32 and a gap element 34 that could be added to the existing columns 36 of such buildings 38 as shown in FIG. 3, or alternatively implemented during the original design and build of new building structures. The lateral movement of the building caused by a seismic event activates the GIB and induces the closing of the system's gap and allows for the protection of the soft first storey. The term "gap" is used broadly in this application, and denotes a means by which a portion of the inclined brace can move axially with respect to a second portion of the inclined brace. Note that while a physical gap is depicted in the schematic versions of the drawings, physical implementations may not include such a structural disconnect between the first portion of the inclined brace and the second portion of the inclined brace. Rather, the gap is one which, when open, prevents tensional forces from travelling axially along the brace, and when closed allows compressive forces to be transmitted along the brace. In this manner, the brace is only activated as a brace when sufficient deformation occurs in the column in the direction that compresses the brace element, at which point, the brace is activated to enhance the column behaviour. Preferred implementations of such a gap will be discussed further below.

The design of the braces is effected so as to increase the deformation capacity of columns and to reduce the likelihood of collapse due to P-Delta effects at the ground level without increasing the lateral resistance of the storey significantly above that offered by the columns at the soft storey level. P-Delta effects refer here to the second-order actions generated at the soft-storey level of a building by the lateral displacement of the storeys above. Furthermore, the brace is designed so as to not add considerable limitations to the architectural functionality, in that it does not intrude on the useable interior space of the soft storey.

The gapped-inclined brace (GIB) of the invention consists of a pinned brace with a gap element that is installed at the ground level without inducing any force in the existing elements of the building structure—by virtue of the gap element which effectively results in the prevention of axial forces being transmitted via the brace element until lateral displacement of the building causes the gap to close. This is shown schematically in FIG. 4A, where a representative building column 20 is shown having a pair of braces 42 with a gap element 40. As the column 20 moves laterally, as shown in FIG. 4B, an elastic rotation of the GIB arises, and one of the gaps 40 is closed. The gap 40 serves to delay the increase of the lateral strength provided by the GIB 10 so that this lateral resistance can be used to compensate reductions in lateral resistance of the existing, or newly built structures that occur with increasing displacement demands, and controls the force that is transferred from the soft storey into the rest of the structure above. Thus, the building remains subject to low accelerations when the lateral movement is not significant, and once the column 20 reaches a critical deformation, the gap 40 is closed, and the axial load from the existing column 20 begins to transfer to the GIB system 10. This critical displacement is set by considering either P-Delta effects or column deformation limits at the first floor. The fact that the braces 42 can be installed without applying any force (via jacking or similar) represents significant benefits for construction, limiting construction costs and time.

Figure 4C:
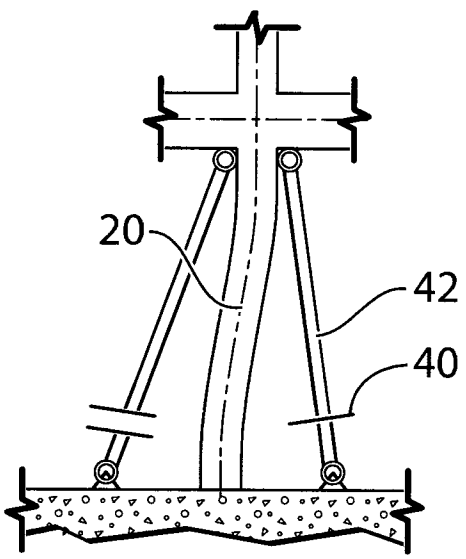
FIGS. 4A, 4B and 4C schematically illustrate the normal state of a building employing the GIB of the invention, a state in which the brace is activated, and one where the brace reaches a steady-state activated position, respectively.
Figure 4B:
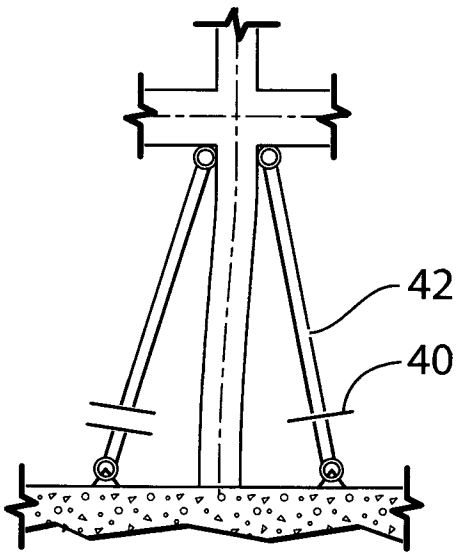
Figure 4A:
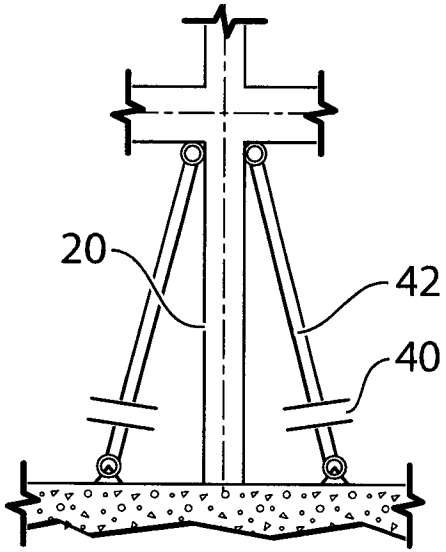

Referring to FIG. 4C, there is shown a deformed state of the system when the ultimate displacement of the column 20 is reached. At this point, the brace 42, with the gap 40 closed compensates for the displaced and deformed column to thus support the structure of the building. Thus, the overall lateral resistance of the building even after the GIB 10 is installed is similar to that of the unretrofitted building but the retrofitted system has the added advantage that the structure can undergo significantly larger lateral deformations. The properties of the GIB are defined based on three major parameters: The initial GIB angle, the gap distance, and the properties of the inclined brace. These parameters are obtained from a systematic design procedure based on closed form equations.

Initial Position of the GIB

Figures 5A, 5B, 5C:
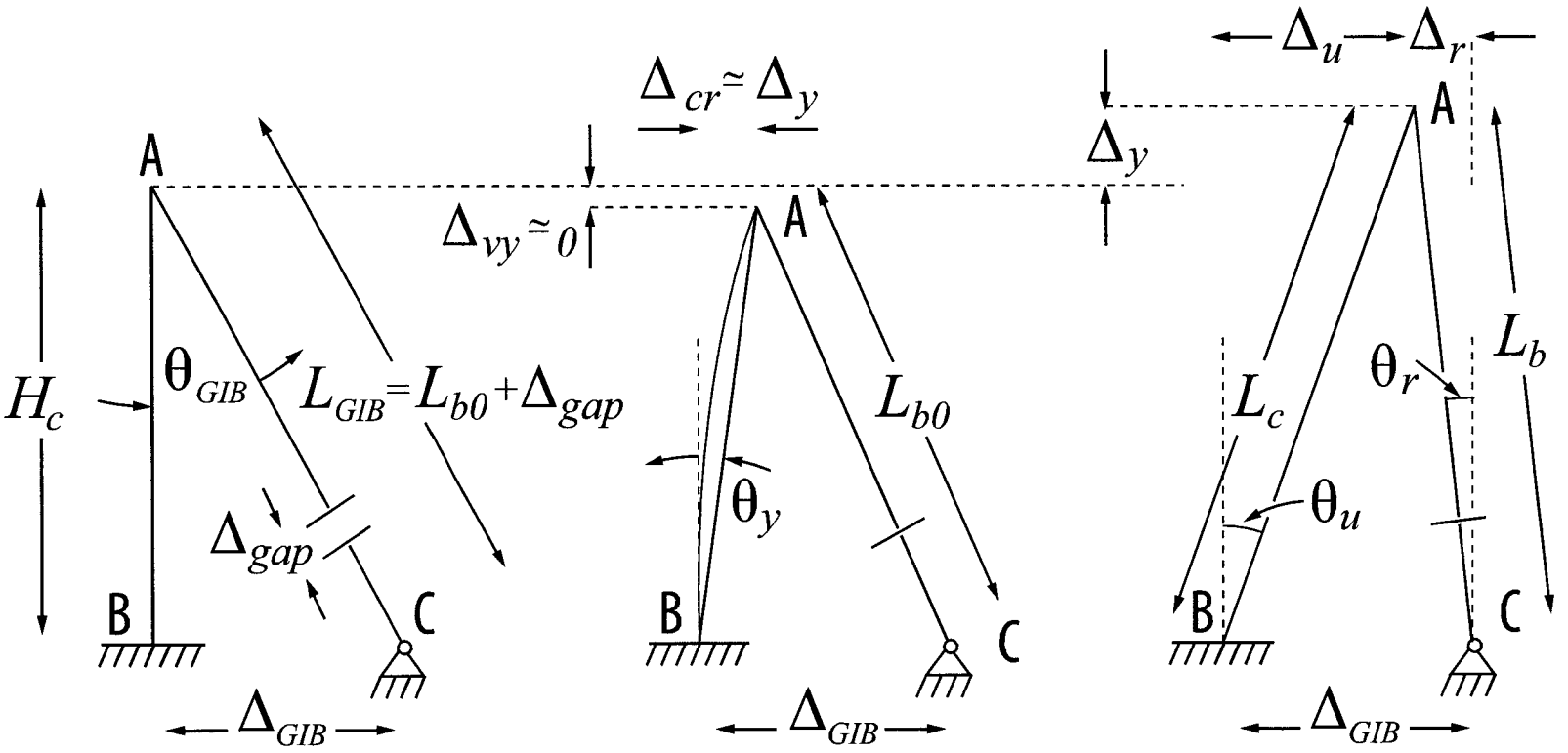
FIGS. 5A, 5B and 5C show the initial position, elastic behaviour of the column before the gap is closed and the post yielding condition of the column, respectively.

Referring now to FIGS. 5A, 5B, and 5C, the initial angle between the existing column and GIB $\theta_{gap}$ controls the total lateral resistance of the system. The lateral resistance of the GIB should ideally compensate for the lateral strength degradation of the column, which decreases from the yield strength $V_y$,col to the ultimate strength $V_u$,col. Thus, the initial angle of the GIB $\theta_{GIB}$, and $\Delta_{GIB}$, shown in FIG. 3, is given by $$\theta_{GIB} = \tan^{-1}\frac{F_{y,col} - F_{u,col}}{P_0 - P_c} + \theta_u, \tag{1}$$

$$\Delta_{GIB} = H_c \times \tan(\theta_{GIB})$$

where $F_{y,col}$ is the yield lateral resistance of the first storey columns under the initial axial force $P_0$ (both dead load and live load); $F_{u,col}$ is its ultimate lateral resistance of the first storey column when the axial load is reduces to $P_u$, which occurs at ultimate lateral drift ratio $\theta_u$. The gap distance $\Delta_{gap}$ is the difference between the initial length of the GIB, $L_{GIB}$, and the initial length of the inclined brace $L_{b0}$ $$\Delta_{gap} = L_{GIB} - L_{b0} = \frac{H_c}{\cos(\theta_{GIB})} - \frac{H_c + \Delta_{vy}}{\cos(\theta_{GIB} - \theta_y)} \quad (2)$$

Where, $\Delta_{vy}$ is the vertical displacement of the column at yield, which could be assumed negligible even though this assumption is not likely to be very accurate for exterior columns, because their axial forces are altered due to the overturning moments.

Design of the Inclined Brace

From geometrical compatibility, the deformation of the inclined brace could be obtained from the difference between its initial length (when gap has just closed) and the compressed length during the loading history $$\Delta L_b = L_{b0} - L_b = \frac{H_c}{\cos(\theta_{GIB} - \theta_y)} - (H_c + \Delta L_C)\frac{\cos(\theta_x)}{\cos(\theta_{GIB} - \theta_x)} \quad (3)$$

Where, $\Delta L_c$ is the axial elongation of the existing column and could be considerable as the compressive force of the column at the ultimate state is significantly reduced. Thus, by dividing the axial force of the inclined brace by its axial deformation (Equation 3), the required axial stiffness of the inclined brace can be determined. The brace axial deformation is also required to ensure that the brace comes into contact at the drift corresponding to the column yield and reaches the design resistance at column ultimate drift.

Analytical Verification

To verify the proposed approach, the cyclic response of a single-bay RC frame retrofitted using the proposed approach and subjected to a quasi-static loading is analytically presented. The frame is assumed the first floor of an open ground storey building. The length of the span and the frame height are set to 5.0 m and 3.0 m, respectively (FIG. 5.*a*). The 0.40×0.40 m RC columns have 3.0 m height, longitudinal reinforcement ratio of 0.01 and confinement factor of 1.15. The beam has a height of 500 mm and width of 300 mm, and has a longitudinal reinforcement ratio of 0.008, which is distributed symmetrically at the top and bottom of the section. By doing so, plastic hinges are formed at the top and bottom of the column, and a column sway mechanism governs.

The column lateral force at the initial axial load ratio of 0.5 is 170 kN. The distance between the GIB and the centerline of the existing columns is obtained $\Delta_{GIB}$=240 mm. Thus, GIBs occupy less than 15% of the frame span, which does not impact the architectural functionality considerably. The gap distance is obtained as 1.3 mm, and a steel square hollow section (HSS 127×127×13 CSA grade H) is used as the inclined brace. The GIB is located on both sides of the existing column to allow for cyclic reversed loading. The axial load is carried through bearing in the closed gap elements, and no additional force is transferred to the system when the gaps are opened.

Figure 8:
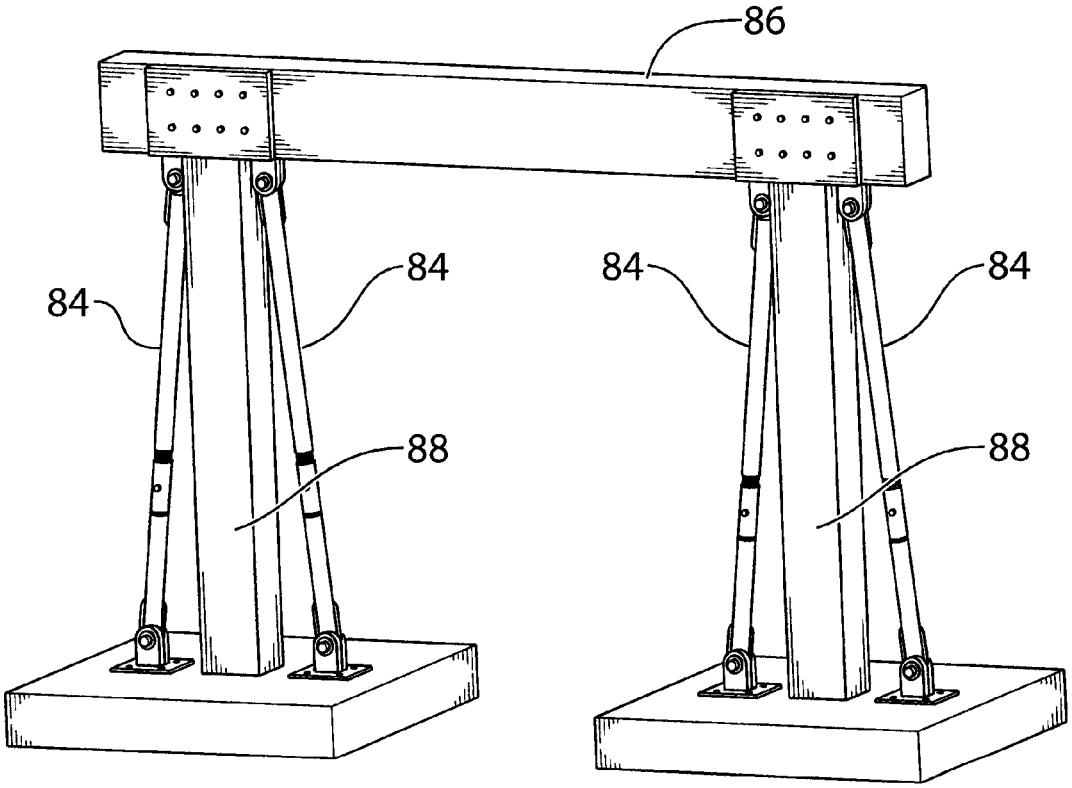
FIG. 8 shows another embodiment of a connection of a GIB to a column in a building structure.
Figure 9:
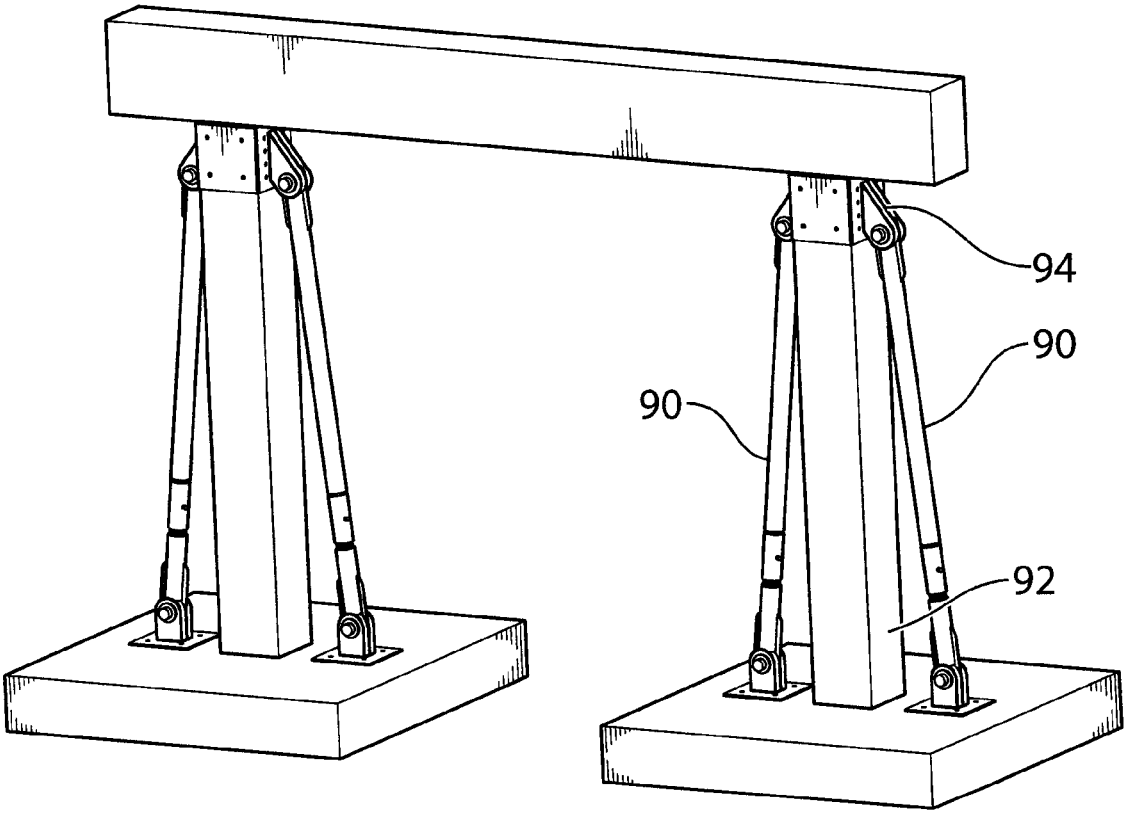
FIG. 9 shows another embodiment of a connection of a GIB to a column in a building structure.

To deal with the constructability issues, both the bottom and the top of the brace may be offset (FIG. 8 and FIG. 9). Such a connection may introduce a need to resist moments due to the eccentricity, but it is beneficial because it increases the construction tolerance. In addition, if the GIBs are located at both sides of the column it increases the confinement of the concrete at the top of the RC column. When connecting GIBs to beams (FIG. 8), care should be taken to prevent beam shear failure where the beam and the GIB are connected. However, the detailed design of the connections is not presented as it is not the focus at this stage.

Figure 6:
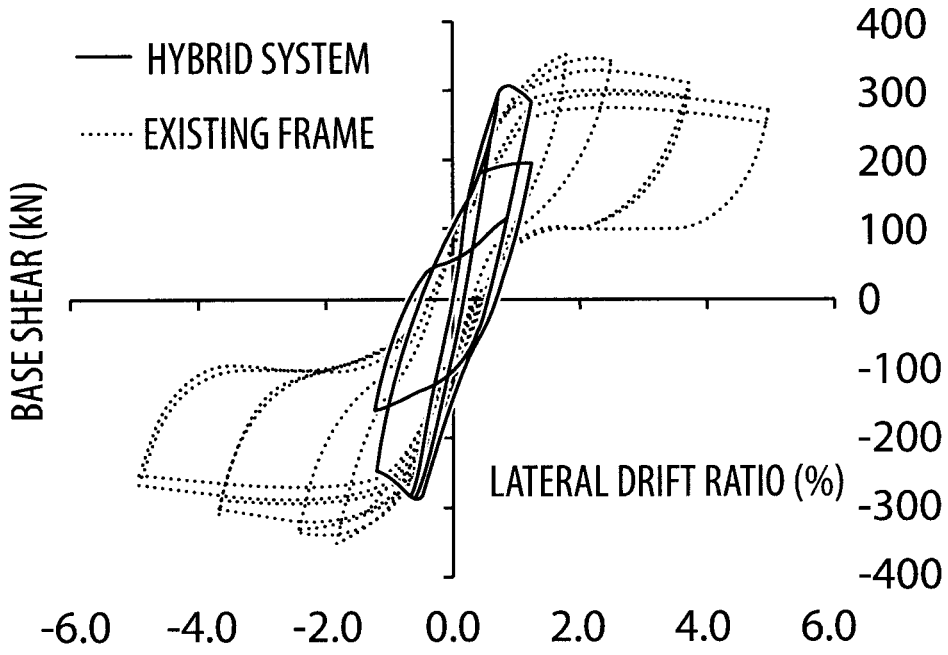
FIG. 6 shows the total force deflection response of the system (the frame and the GIB), obtained from a fibre-element model.

FIG. 6 shows the total hysteretic response of the entire system (the frame and the GIB), obtained from a fibre-element mode, and compares to the response of the existing frame. The hysteretic response of the system exhibits a self-centering response with good energy dissipation capacity, which can significantly reduce demand parameters in the floors above the ground level. The ultimate drift capacity of the system is increased considerably without any notable increase in the resistance. Moreover, the residual displacements greatly reduce to around 1.0% that could be considered acceptable for most existing buildings for the life-safety performance level.

It was also observed that if the inclined brace is allowed to yield (using buckling resistant braces or other hysteretic devices), the distance between the column and the GIB can be increased. Using this solution, the hysteretic response of the total system is not significantly different from what was provided with a linear elastic brace. However, due to the plastic deformation of the inclined brace, the residual displacement of the system could be increased. It was found that using braces with nonlinear elastic behavior (post tensioning of the inclined brace or Self Centering Energy dissipative braces) could further reduce the residual displacement.

It should be noted that the series of equations that were described (Equations 1 to 3) represent one possible design strategy that could achieve the intended response of the GIB system. Another possible approach consists of computing the required stiffness of the inclined brace by assuming that the work done by the external actions is equal to that of the internal forces.

Exemplary Implementations

Figure 7:
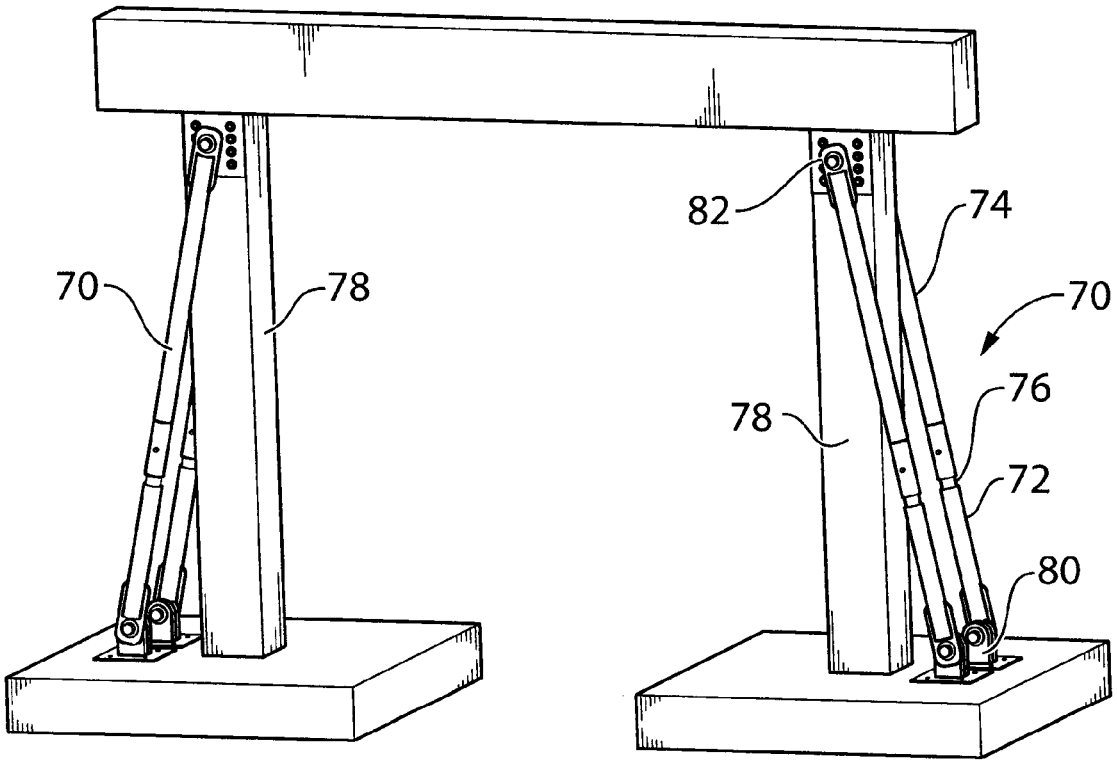
FIG. 7 shows one embodiment of the connection of a GIB to a column in a building structure.

Referring now to FIG. 7, there is shown one exemplary implementation of a gapped-inclined brace 70 according to the invention. The brace 70 consists of a first tubular member 72 and a second tubular member 74. The first tubular member 72 is sized, and otherwise dimensioned to be slidable within the second tubular member 74. In one variation, the member 72 is not necessarily tubular, and may be a solid member slidable within tubular member 74. The first member 72 is slidable within the second member 74 until a stop surface 76 is engaged. In the illustrated embodiment, the stop surface 76 is formed by an increase in diameter on the first member 72 which prevents further sliding movement of the first member 72 within the second member 74. With this arrangement, the brace 70 has a gap provided which does not carry any load from the column when it is installed, or when the gap is enlarged by the first member 72 sliding outwardly from the second member 74. The gap is provided by the free sliding movement available until the stop surface 76 is engaged. The result is that when the brace 70 is in tension, no loads are carried by the brace 70, and it operates in a stand-by configuration. When the column 78 moves in a manner that applies a compressive force to the brace 70, the gap is closed until the stop surface 76 is engaged, at which point the brace 70 carries compressive forces, thus supporting the column 78 against further deformation. Since the brace 70 is installed at a near vertical angle (see the Design of the Inclined Brace section), when the brace 70 develops a load, it does not add significant lateral resistance or stiffness, but rather the brace 70 provides a force against downward movement of the column 78, thus pushing the column 78 upwards. This can be seen in FIG. 16 (schematically shown in FIG. 5.C), for example, which will be discussed in further detail below. The deformation capacity of reinforced concrete columns depends on the axial load that is being carried. As this load is relieved, the deformation capacity increases. In addition, as the column deforms, more axial load is carried by the brace in compression owing to the way it is positioned, and as this load transfer from the column happens, it reduces the P-Delta effects on the reinforced concrete column.

The bottom of the brace 70, which is the bottom of the first member 72 is mounted with a pinned joint 80 to the ground. The top end of the second member 74 is similarly pinned to the column 78, for example by way of a mounting plate 82. The pair of pin joints allows the brace 70 to be fully rotatable at both ends in response to deformation of the column 78. As the brace 70 is connected directly to the column 78, a single brace 70 is provided for each column 78 on the outside of the building for each orthogonal direction.

FIG. 8 shows an alternate arrangement in which the braces 84 are connected to a coupling beam 86, proximate each of the columns 88. In this arrangement, a brace 84 is provided on each side of each column 88 to provide a vertical lifting force to the beam 86 at its contact location with the column 88. The result is similar to as described above.

FIG. 9 shows yet another arrangement in which the braces 90 are mounted in a pin connection similarly to the embodiment of FIG. 7, however, the bracket 94 connecting the brace 90 to the column 92 is offset from the column 92, and in particular, the bracket 94 extends away from the column 92 before the pin connection is formed. This arrangement provides some flexibility in construction tolerances, and provides for ease of installation.

Figure 10:
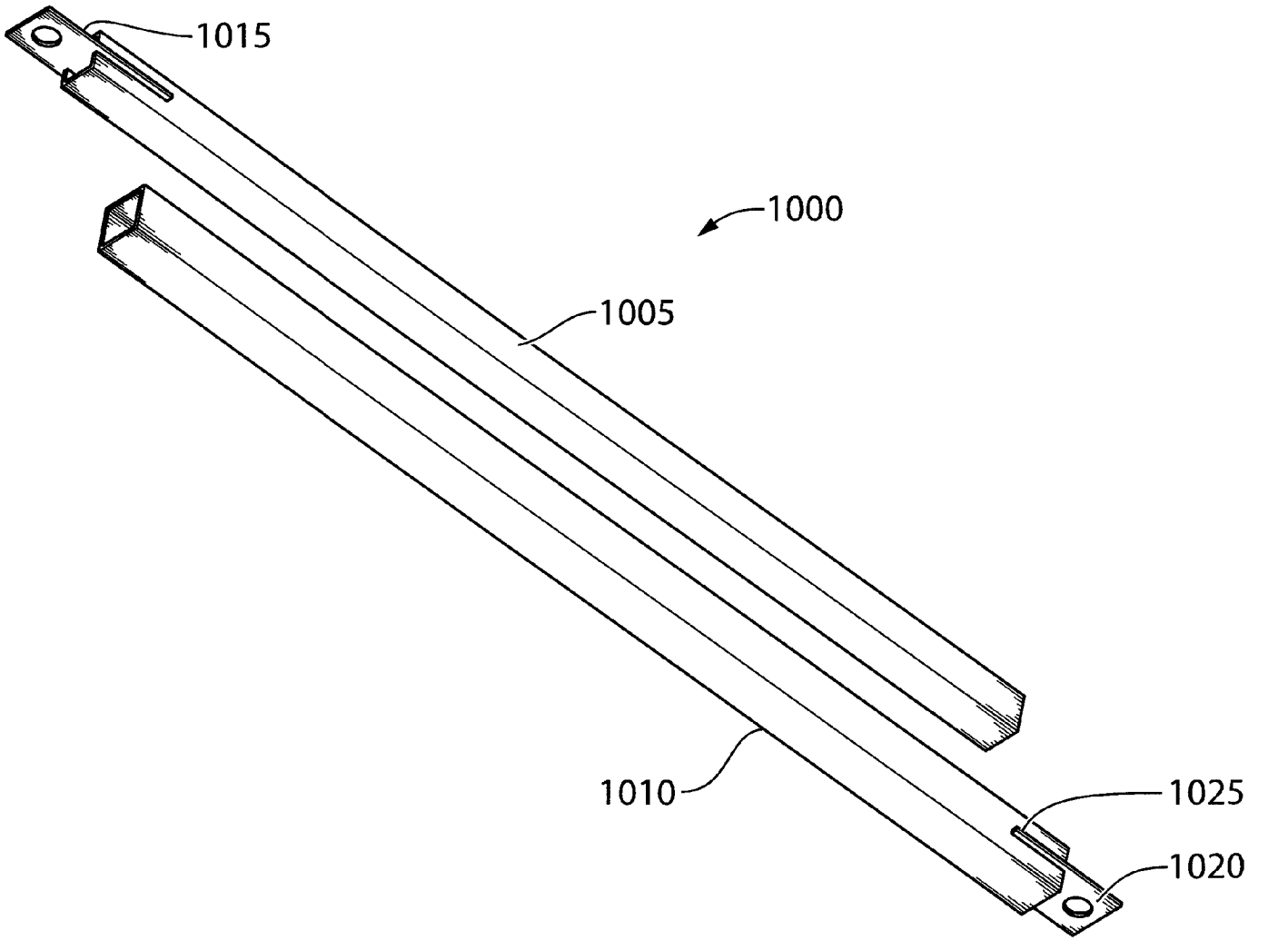
FIG. 10 shows one possible method for construction of the gap inside the GIB according to the invention.

FIG. 10 shows details of the brace, which may be used in any of the arrangements described above. The brace 1000 in FIG. 10 includes a first member 1005 shaped, and otherwise dimensioned to be slidable within a second member 1010. Each of the first 1005 and second 1010 members in this embodiment are tubular, and include brackets 1015, 1020 at ends thereof adapted for attachment to the pin joints as earlier described. A gap is provided by sizing the first member 1005 and the second member 1010 such that the first member 1005 is freely slidable within the second member 1010 when the gap is present. The gap is closed when the first member 1005 bears against an interior lower surface, or alternatively, against an internal end 1025 of the bracket 1020 such that force may be transmitted through the entire brace 1000.

Figure 11A:
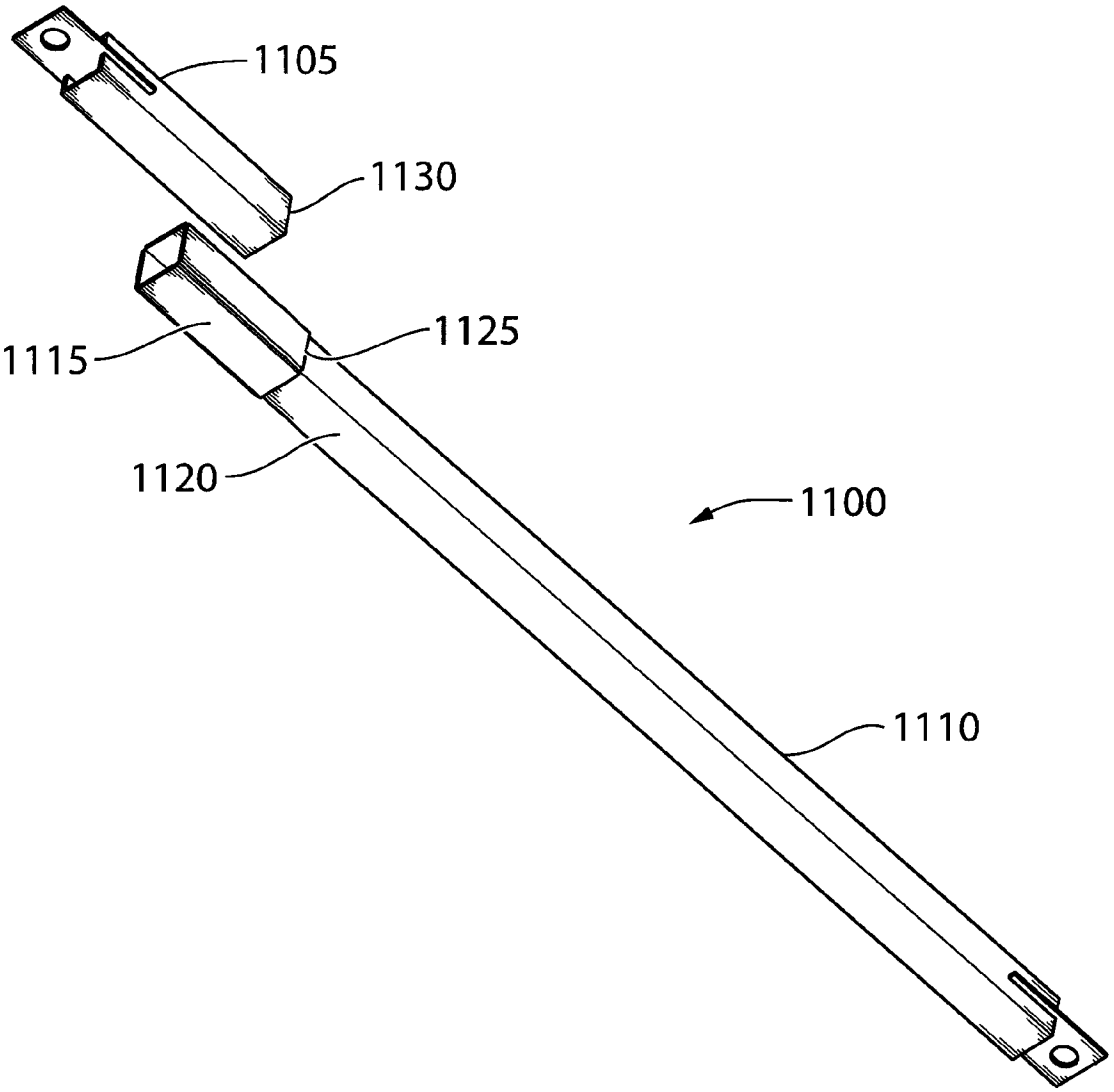
FIGS. 11A and 11B show alternate constructions of the gap inside the GIB.
Figure 11B:
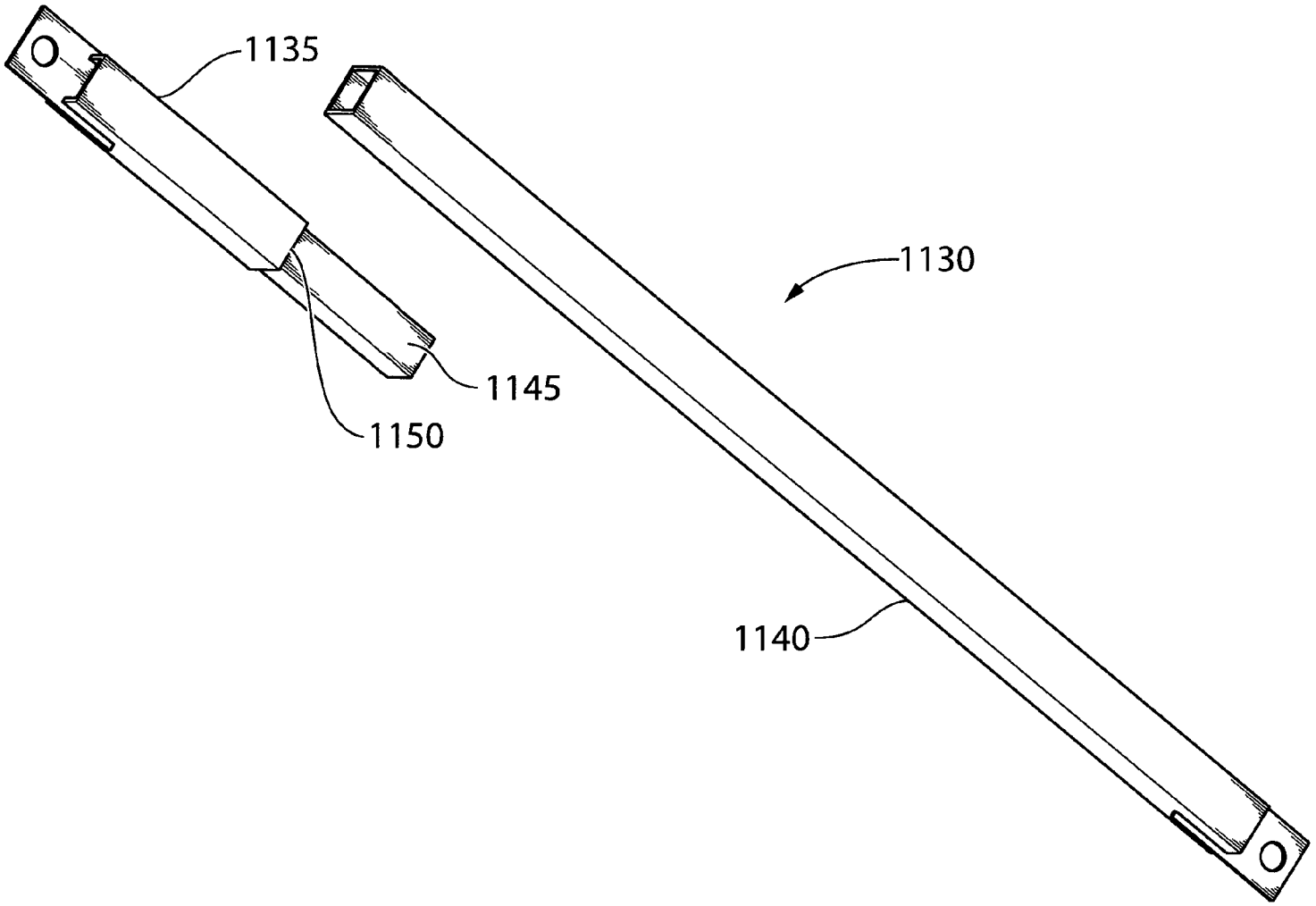

FIG. 11A shows a variation in which a brace 1100 includes a first member 1105 and a second member 1110. The second member 1110 includes a top portion 1115 having a larger cross-sectional dimension than a lower portion 1120. That is, the lower portion 1120 also provides an internal stop 1125 at which the top portion 1115 terminates. The first member 1105 is sized, and otherwise dimensioned to be slidable within the top portion 1115 under normal operation when a gap exists in the brace 1100. The gap closes by virtue of a bottom end 1130 bearing against the internal stop 1125 of the lower portion 1120. Once the first member 1105 bears against the second member 1110 at the internal stop 1125, the gap is closed, and forces are transmittable along the brace 1100. FIG. 11B shows another variation in which a brace 1130 has a first member 1135 and a second member 1140. The first member 1135 includes a lower portion 1145 sized and otherwise dimensioned to be slidable within the second member 1140. The lower portion 1145 of the first member 1135 has a smaller cross-section dimension that the main body of the first member 1135 such that the intersection of the lower portion 1145 with the main body portion provides an internal stop 1150, operating in a manner analogous to that described with respect to FIG. 11A.

Figure 12:
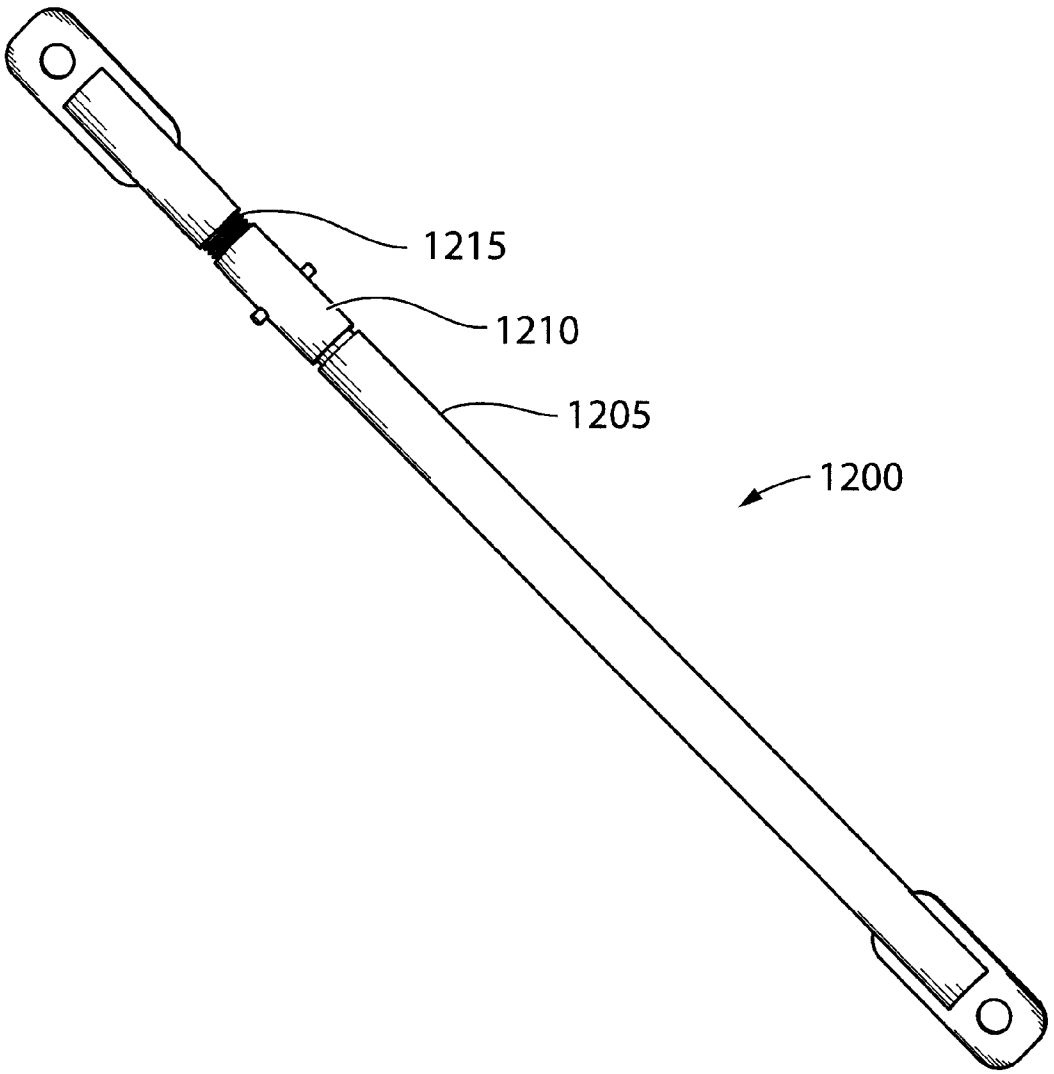
FIG. 12 shows a gapped-inclined brace incorporating and adjustment screw according to another embodiment of the invention.
Figure 13:
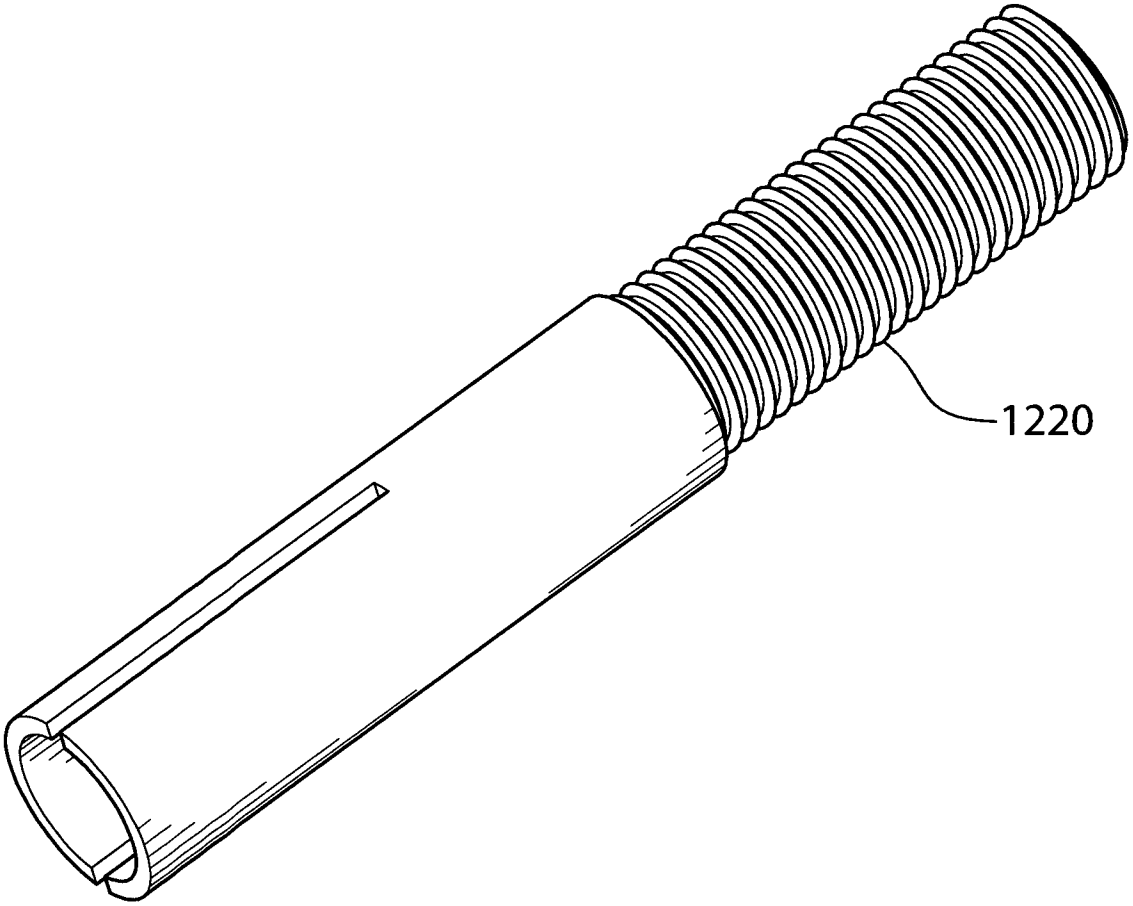
FIG. 13 shows the male portion of the screw of FIG. 12.
Figure 14:
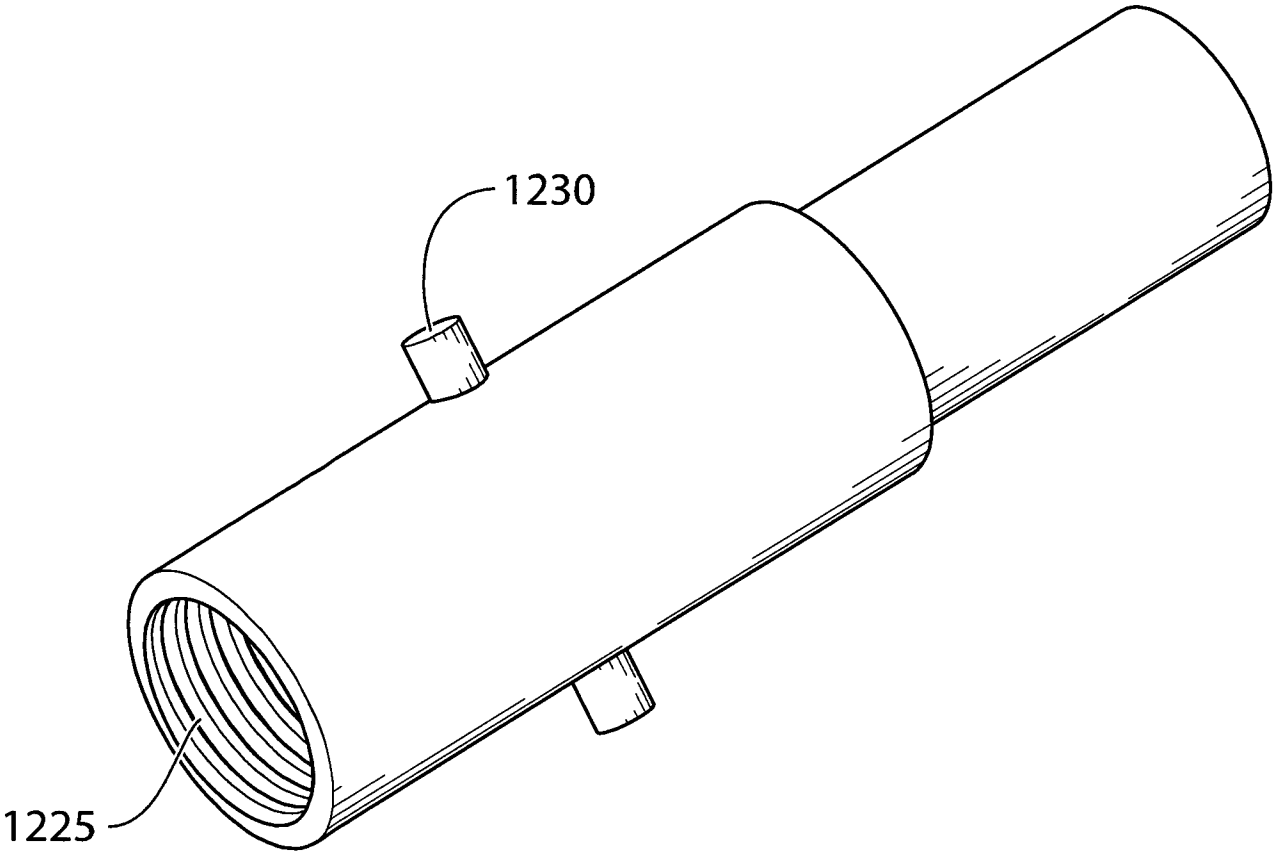
FIG. 14 shows the female portion of the screw of FIG. 12.

FIGS. 12 to 14 shown a variation on the brace, where a brace 1200 having first 1205 and second 1210 portions further includes an adjustment means, illustrated as screw portion 1215. While the screw portion 1215 may be provided at any location on the first 1205 or second 1210 portions, the illustrated embodiment shows the screw 1215 formed on the first portion 1210. The screw portion is shown in more detail in FIGS. 13 and 14, and includes a male portion 1220 and a female portion 1225. Along the body of the female portion 1225 there is also provided a thru hole or cylinder 1230 by which the screw portion can be locked in place, to prevent further rotation of the male portion 1220 within the female portion 1225. The screw is provided so that initial adjustments may be made to the overall length of the brace during construction. Since the gap in the brace is generally small, in the order of a few millimeters, when the brace is installed by connecting it to the frame at both ends and accounting for tolerances of installation, the gap might be increased or decreased as the brace is stretched or compressed for the purposes of installation. The screw is provided to modify the gap after installation to bring it back to the targeted gap opening. Other aspects of the brace may be formed as earlier described.

Figure 15:
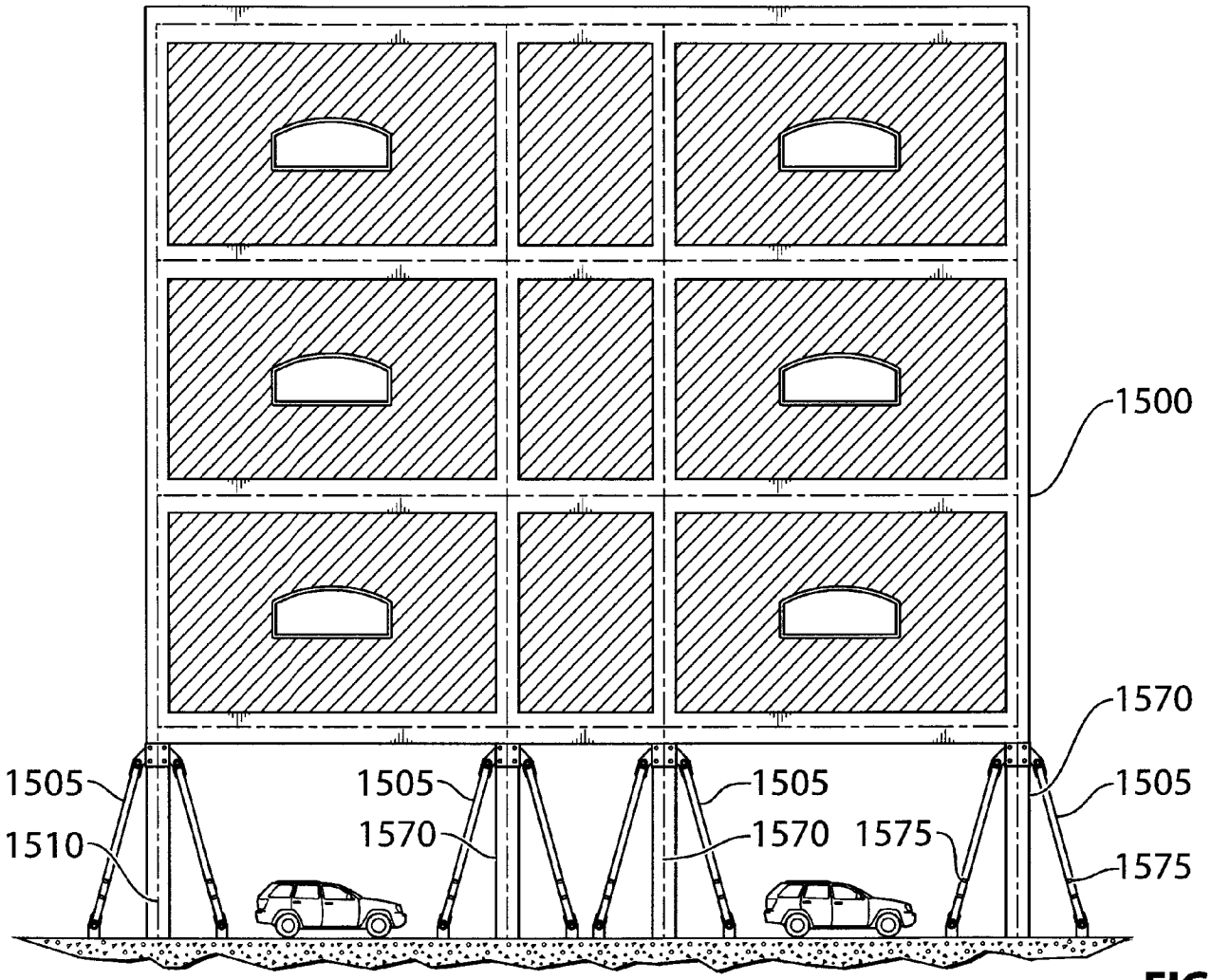
FIG. 15 shows a building structure using GIBs of the invention in its standby configuration.
Figure 16:
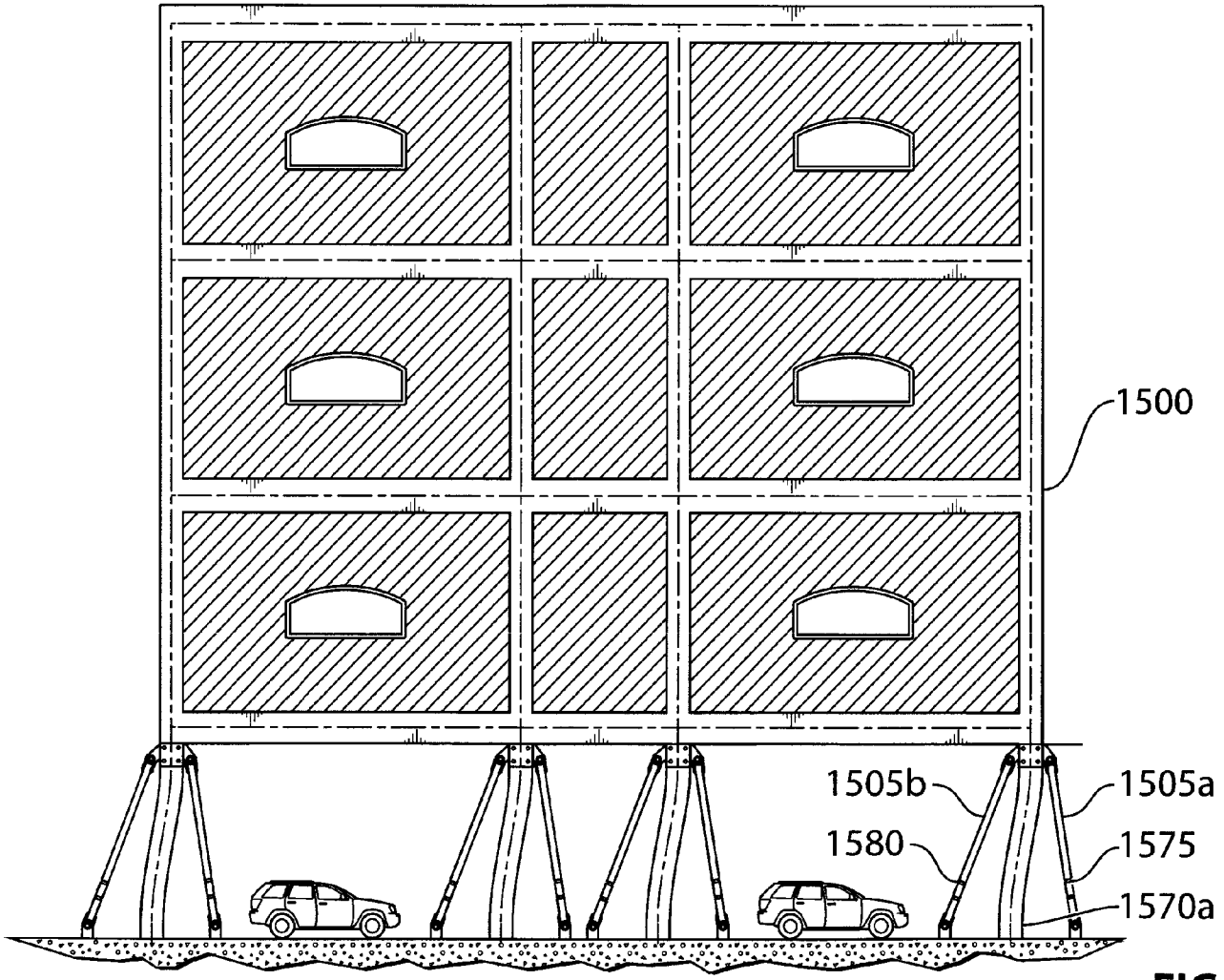
FIG. 16 shows the building structure of FIG. 15 following a seismic event.

Referring now to FIGS. 15 and 16, there is shown a soft-storey building 1500 having a plurality of gapped-inclined braces 1505 supporting a plurality of columns 1510. The brace 1505 in this illustration includes the adjustable screw as illustrated in FIG. 12. FIG. 15 shows the system in its stand-by mode, with the gap 1575 present in each of the braces 1505 such that no vertical forces are transmitted by the braces 1505. FIG. 16 shows the situation in which an event has occurred, such as a seismic event, causing the columns 1570 to deform. This results in the brace 1505*a* rotating about its pivot joints and being moved to a more upright orientation, while the gap 1575 closes to permit vertical forces to be carried by the brace 1505*a*, which thus supports the deformed column 1570*a* and mitigates further damage to the building. It is also noted that the brace 1505*b* positioned on the opposite side of the deformed column 1570*a* extends in such a manner that the gap is enlarged, by virtue of the top of the column 1570*a* moving further away from the bottom of the brace 1505*b*. If the deformation were to be in the opposite direction, the opening and closing of the gaps 1505*a* and 1505*b* would be reversed.

Figure 17:
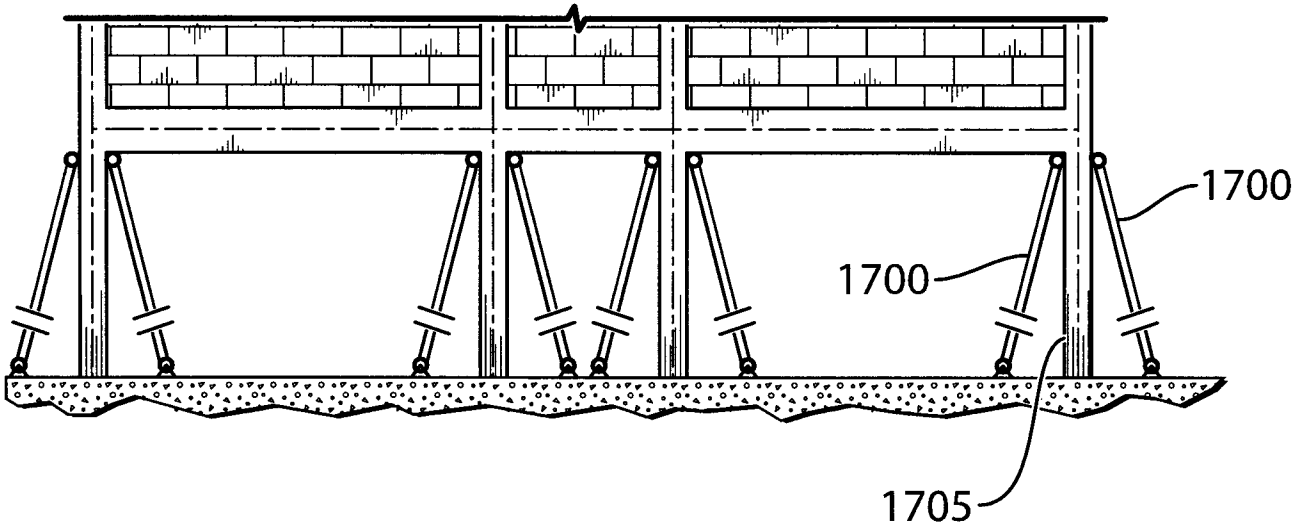
FIG. 17 shows an arrangement of gapped-inclined braces of the invention installed on columns of a building structure.
Figure 18:
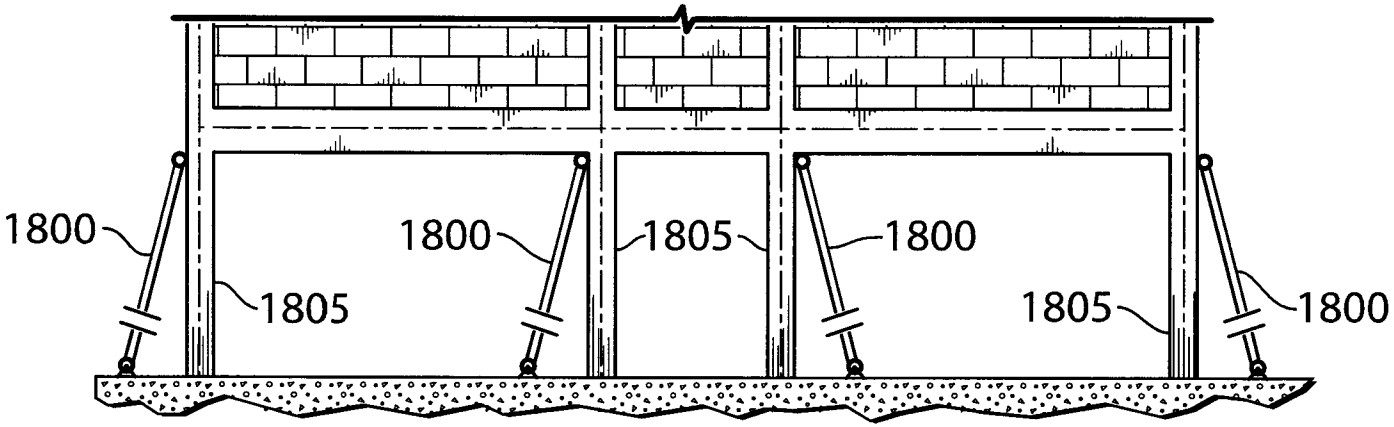
FIG. 18 shows an alternate arrangement GIBs of the invention installed on columns of a building structure.
Figure 19:
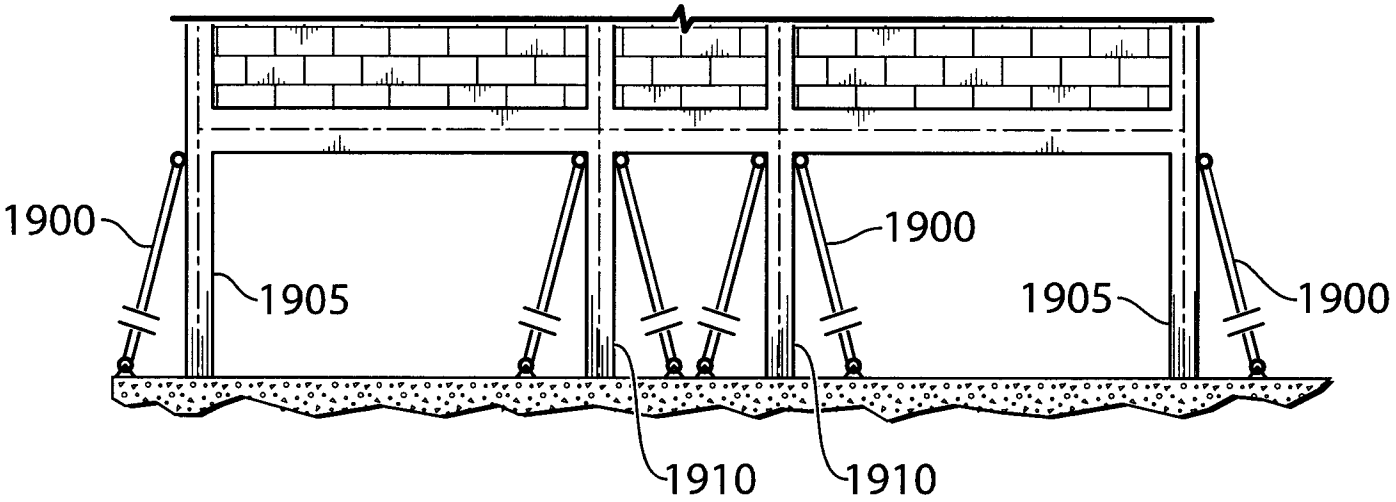
FIG. 19 shows another alternate arrangement of GIBs of the invention installed on columns of a building structure.

FIGS. 17-19 show various arrangements of how the gap-inclined braces 1700 may be implemented. FIG. 17 shows an arrangement in which each column 1705 in the building structure has a brace 1700 on either side of the column. FIG. 18 shows an arrangement where braces 1800 are positioned only on the outer sides of each column 1805. FIG. 19 shows a hybrid arrangement of FIGS. 17 and 18, where a brace 1900 is provided on the outside of exterior columns 1905, but on both sides of interior columns 1910. Each of these configurations will be selected depending on the specific building requirements and geographic location of the building in which they are installed. Furthermore, design considerations and sizing of the brace may dictate which arrangement is used.

Figure 20:
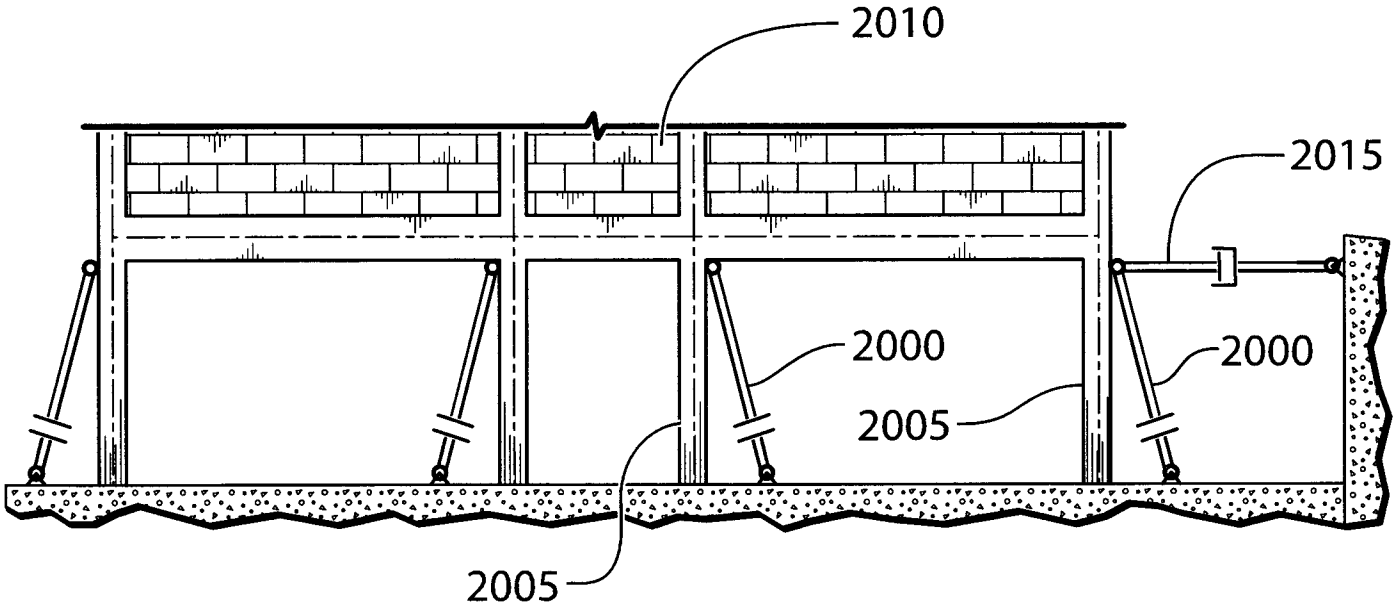
FIG. 20 shows a building structure incorporating the GIBs and a supplementary damper.

FIG. 20 shows an implementation where gapped-inclined braces 2000 are applied to columns 2005 in a building structure 2010, in combination with supplementary damping means 2015. The damping means 2015 may be any suitable damper known in the art to damp against vibrations in the structure. These dampers are known in the art, and not new to this invention. However, their implementation in combination with the gapped-inclined braces is considered to have additional benefits, as the damper may reduce movement in the first storey of the building. Preferably, the damping means 2015 is connected directly to the pinned joint of one of the braces, however, this is not essential.

Figure 21:
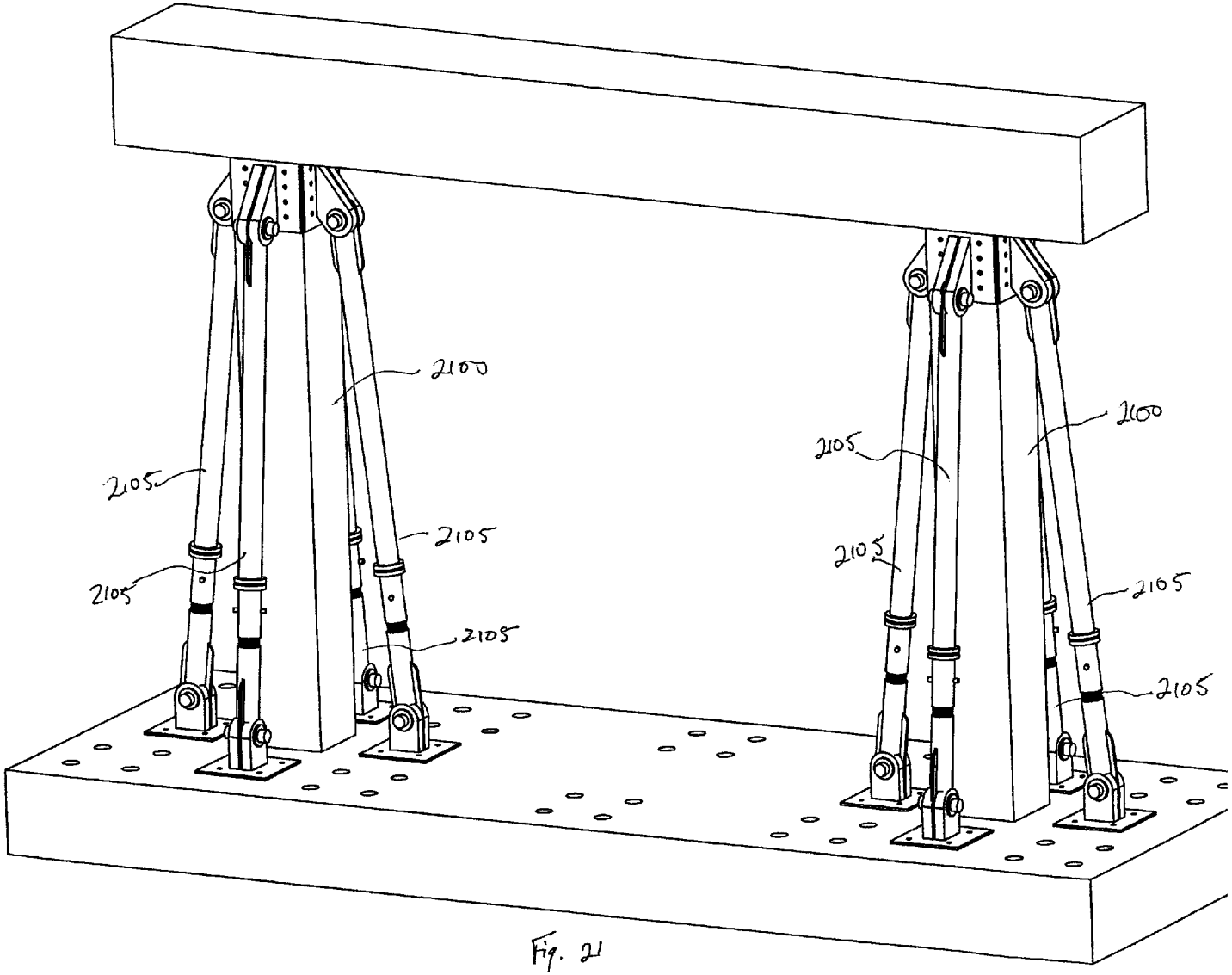
FIG. 21 shows a three-dimensional implementation of the GIBs according to the invention.
Figure 22A:
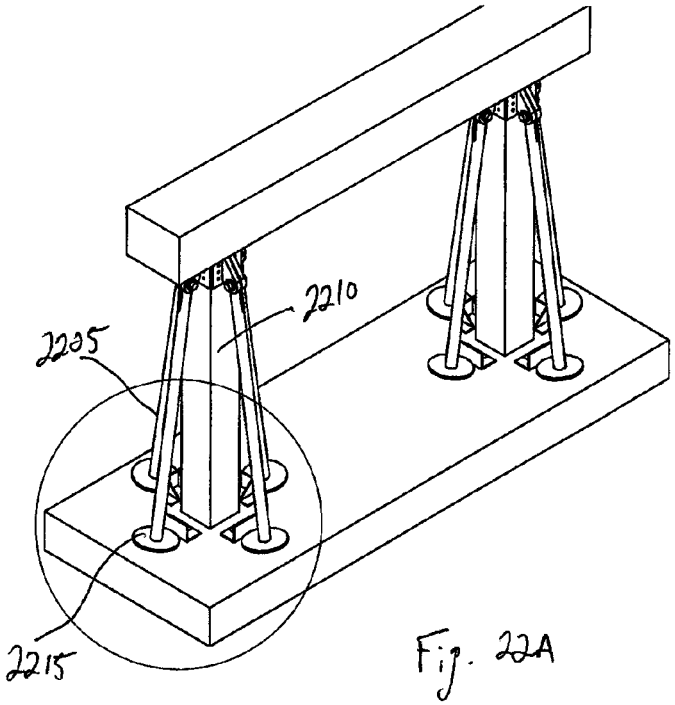
FIGS. 22A, 22B and 23A, 23B show an alternate implementation in which a contiguous brace is used, with the gap formed at the intersection of the brace and the ground floor.
Figure 22B:
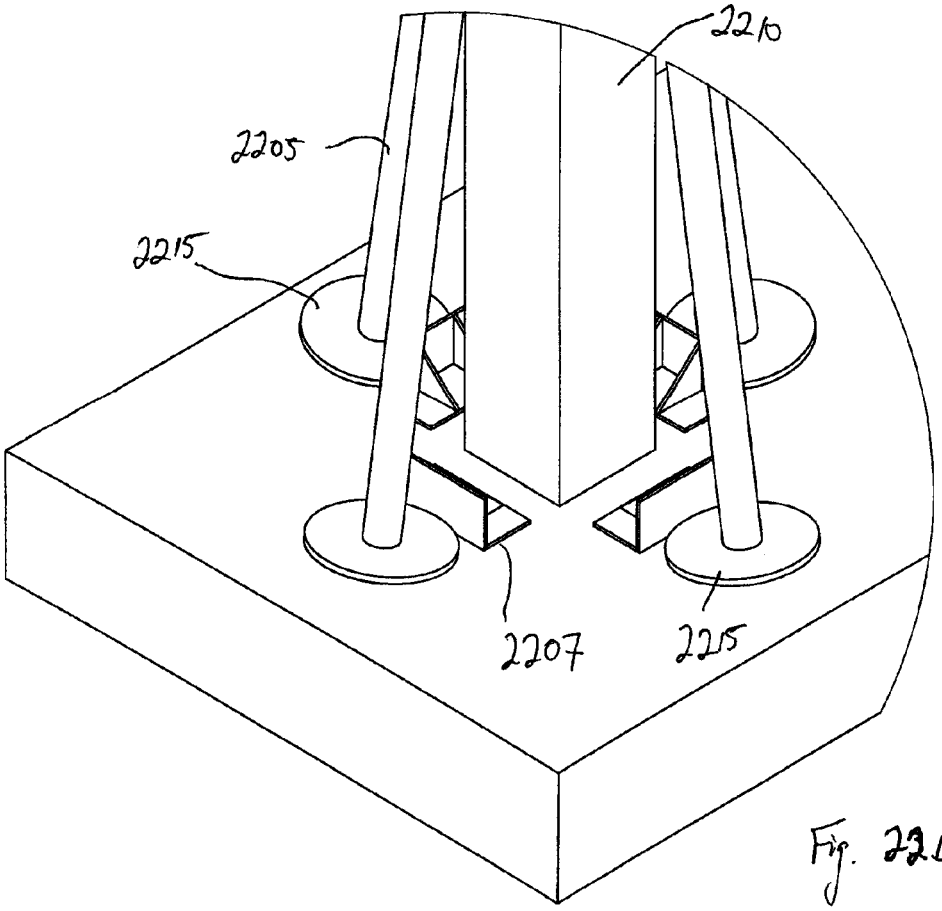
Figure 23A:
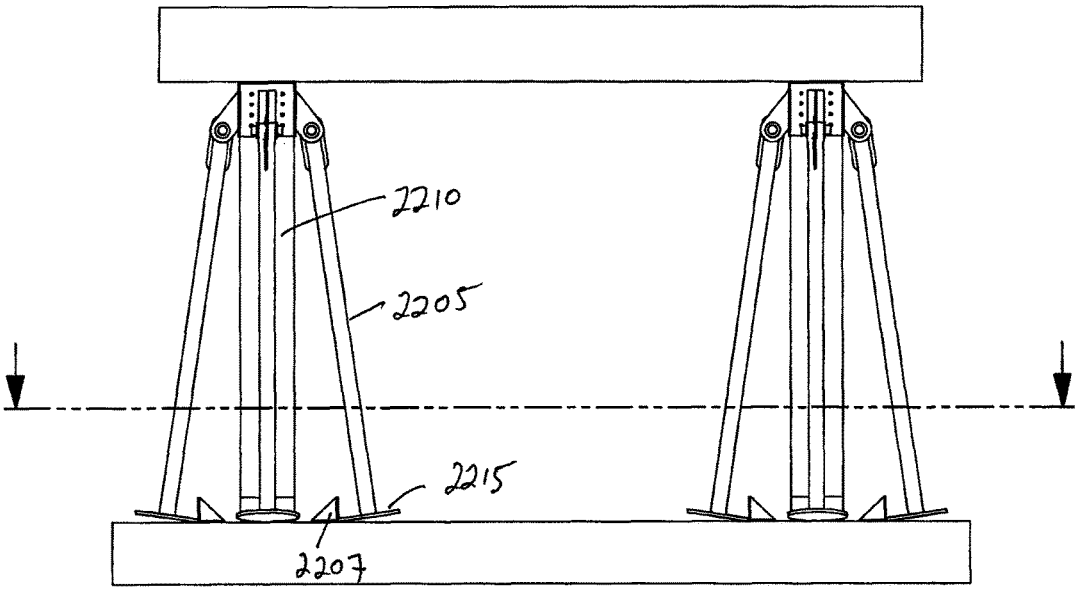
Figure 23B:
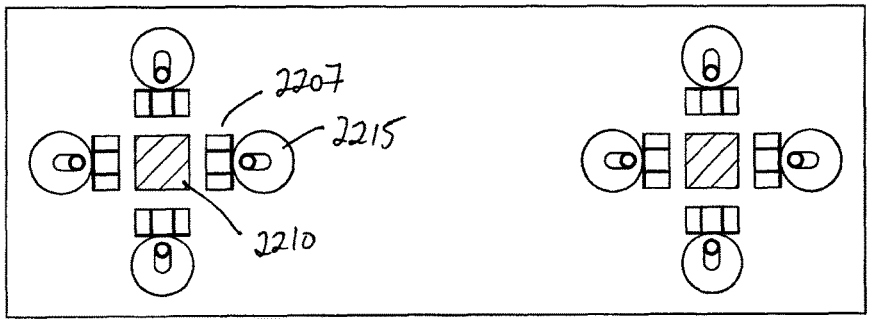

While the various embodiments herein described have shown examples of implementation where braces are positioned in the same plane on opposite sides of a column representing a two-dimensional implementation supporting deformation of a building in one direction, the teachings of the invention are equally applicable to out-of-plane or three-dimensional implementations as well. Referring to FIG. 21, there is shown a pair of columns 2100, each having four associated gapped-inclined braces 2105 in order to permit the functionality of the braces as herein described in three-dimensions, and thus supporting the columns 2100 following a seismic event regardless of the direction of sway the building undergoes. The braces 2105 may be any of the braces as herein described and are not limited to the particular form shown in FIG. 21 for the three-dimensional implementation.

Other arrangements for generating the gap are also contemplated provided that the brace has a first configuration in which a gap is formed thereby preventing the transmission of force axially along the brace, and a second configuration in which the gap is closed to permit the transmission of forces axially along the brace. For example, referring now to FIGS. 22A, 22B and 23A, 23B, there is shown an embodiment of the invention in which the braces 2205 are inclined and pin connected to a top of the columns 2210. The braces 2205 in this embodiment are continuous braces having a disc-shaped plate 2215 at bottom ends thereof. The braces 2205 are fixed to the disc-shaped plates 2215, which are in contact with the foundation or ground surface, but are not rigidly affixed thereto. A stop element 2207 prevents movement towards the column 2210 of the disc-shaped plates 2215 and the brace 2205, which is necessary due to there not being a connection to the ground surface. During normal operation, the disc-shaped plates 2215 are inclined and provide a contact point with the foundation by way of the stop element 2207 for positional support only. However, no compression forces are transmitted along the braces 2205 until deformation occurs resulting in any one or more of the braces 2205 rotating such that its respective disc-shaped plate 2215 rests flat with respect to the ground, such that its entire surface area is in contact with the ground. Once this occurs, the gap between the disc-shaped plate 2215 and the ground is closed and compressive forces may be transmitted along the brace 2205.

Figure 24:
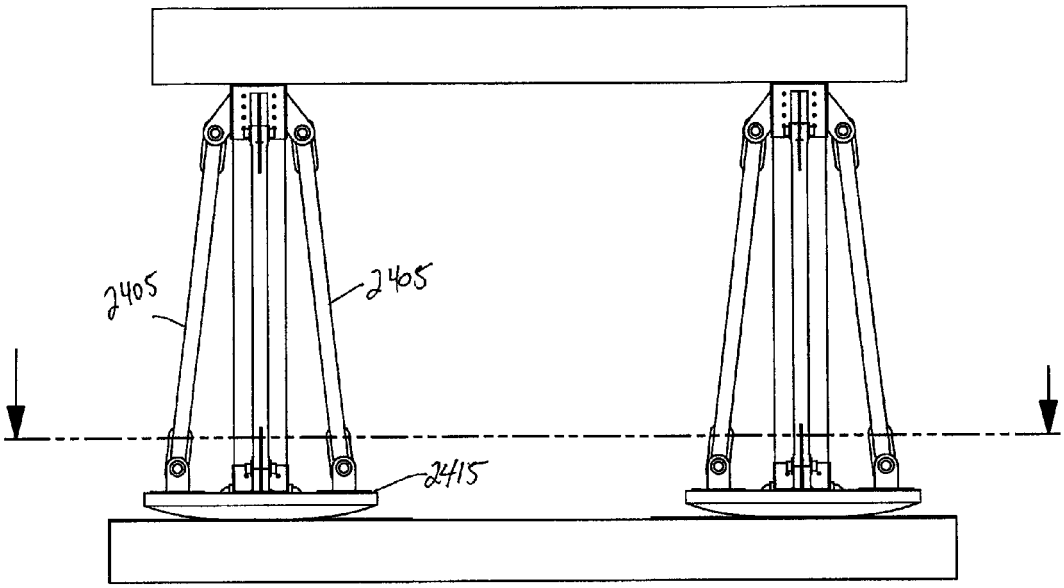
FIGS. 24 and 25 show another implementation in which multiple contiguous braces are connected to a singular gap member.
Figure 25:
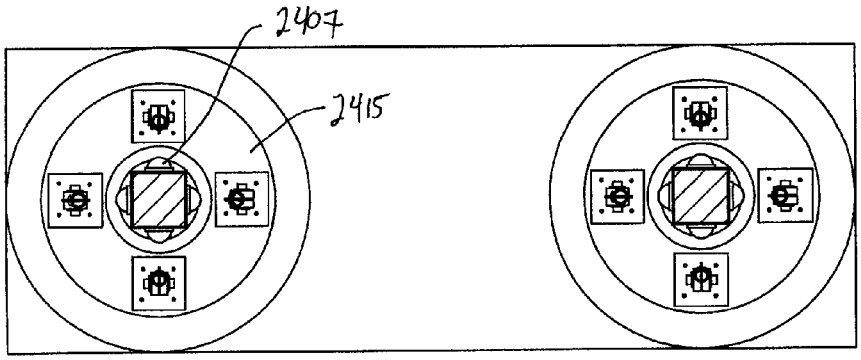
Figure 26A:
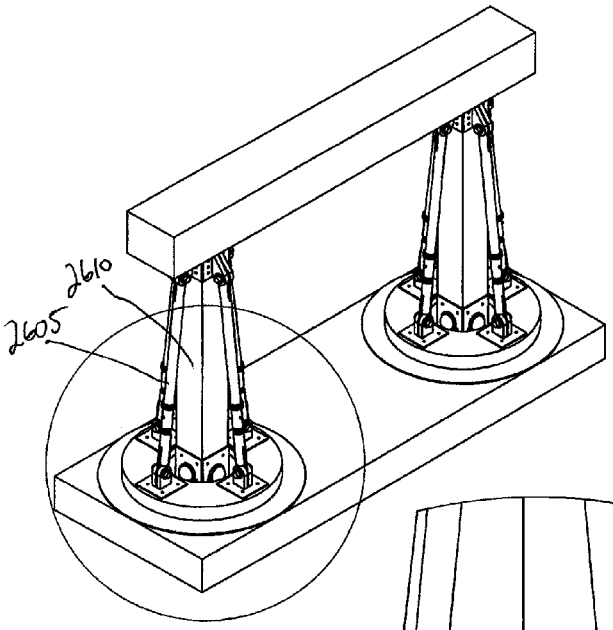
FIGS. 26A, 26B and 27A and 27B show another variation of the invention, where the gap is provided in the horizontal distance between the braces and the column.
Figure 26B:
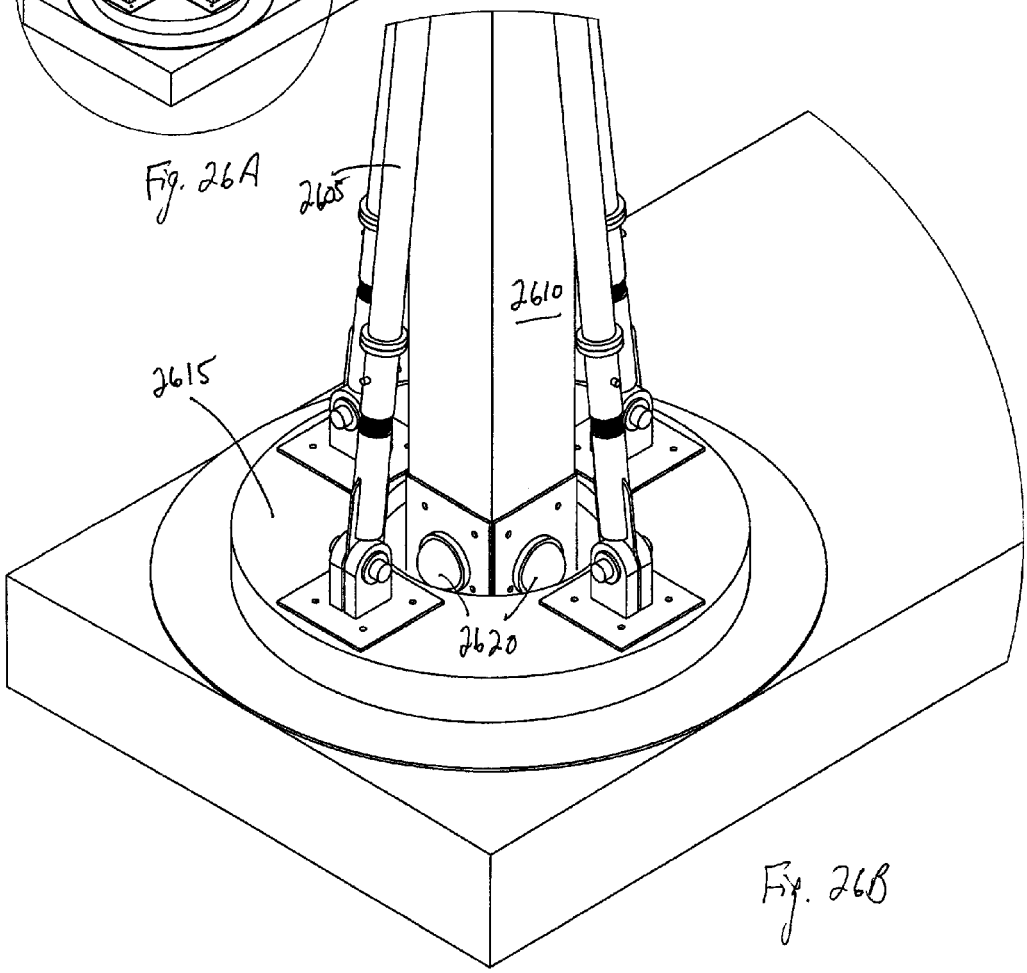
Figure 27A:
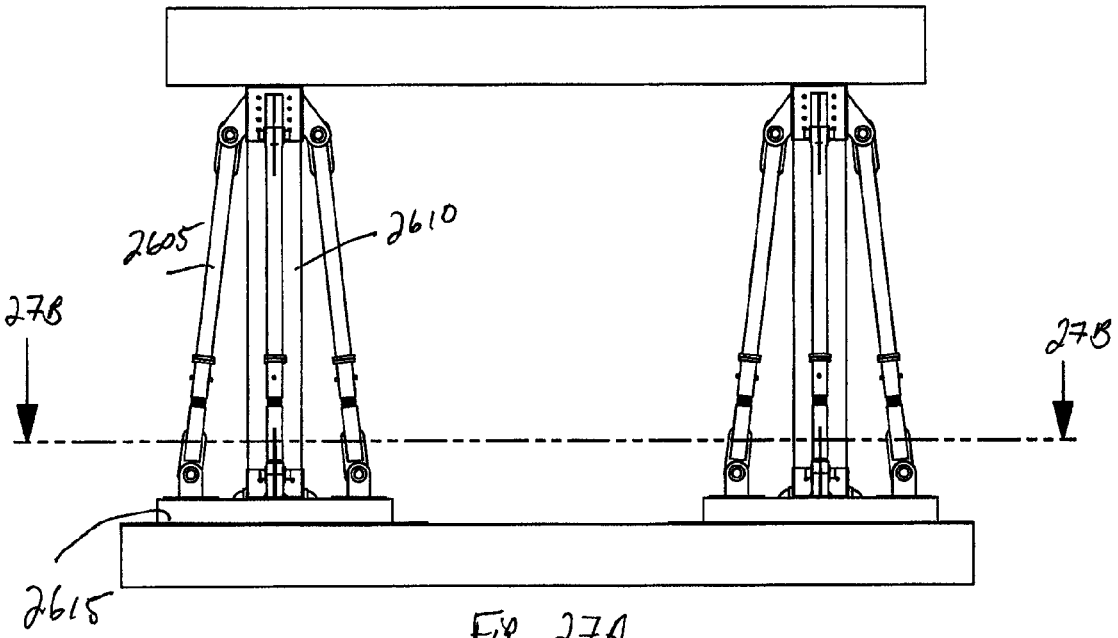
Figure 27B:
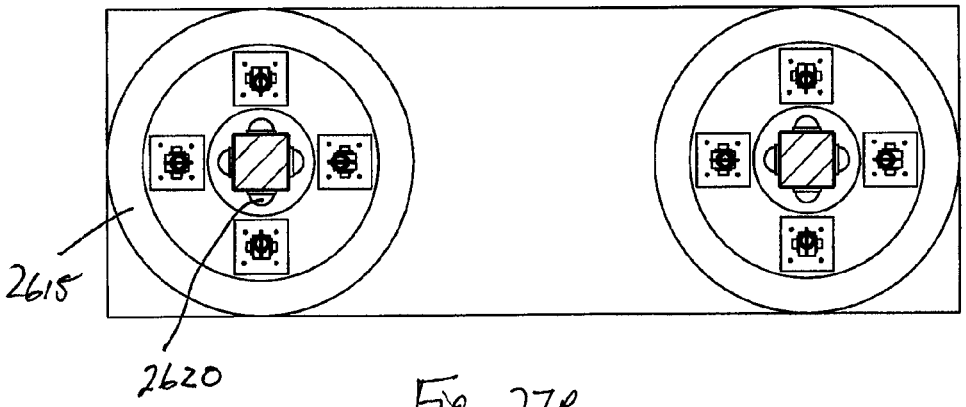
Figure 28A:
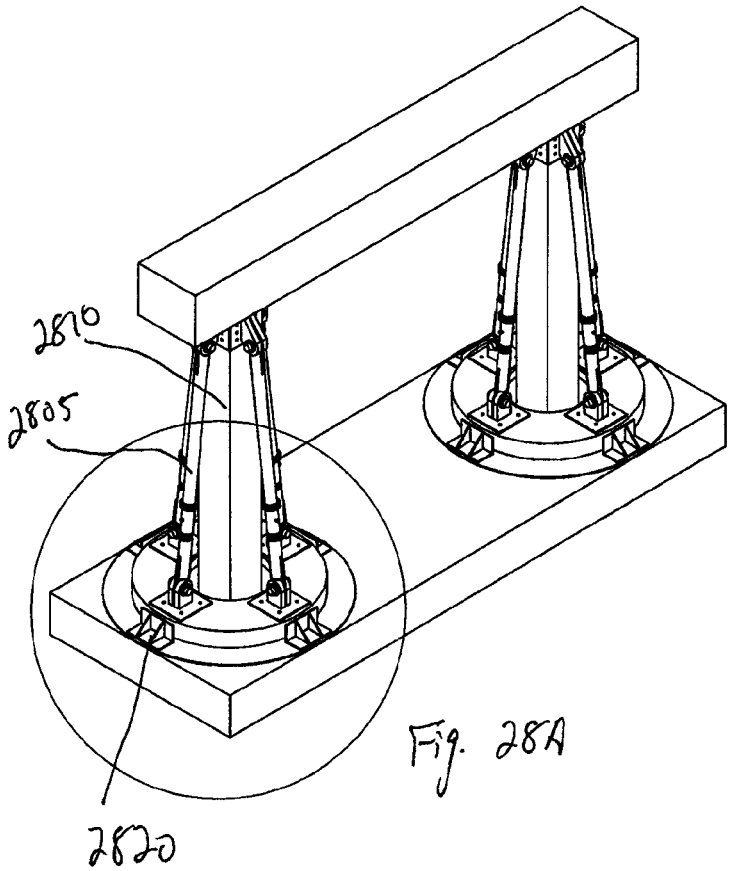
FIGS. 28A, 28B and 29A and 29B shows a variation on the embodiment of FIGS. 26 and 27.
Figure 28B:
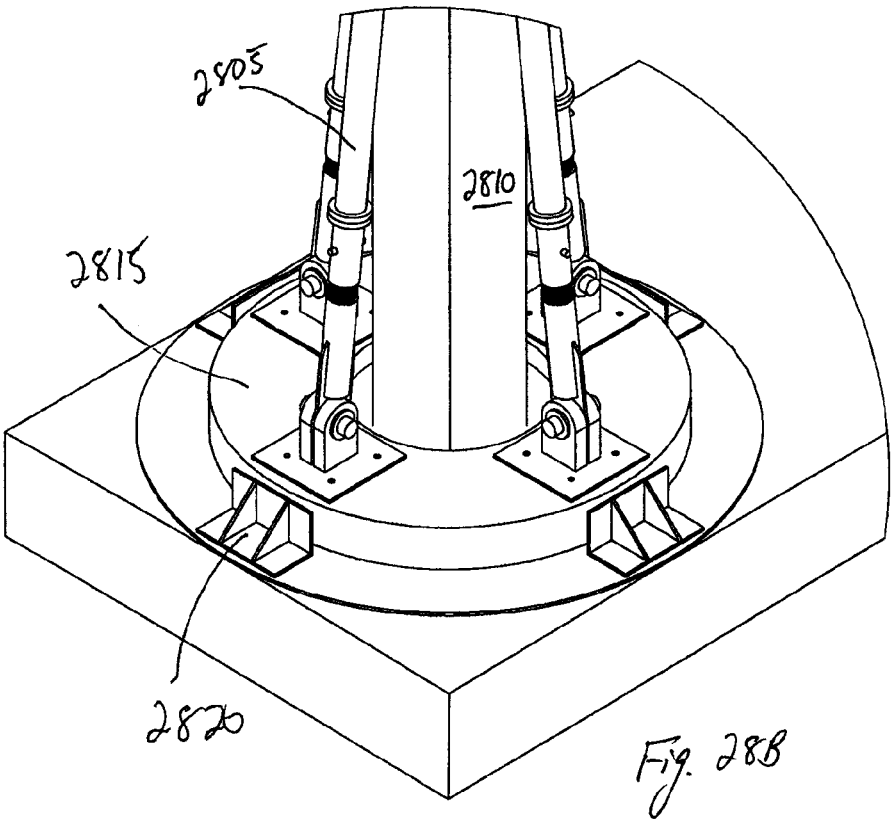
Figure 29A:
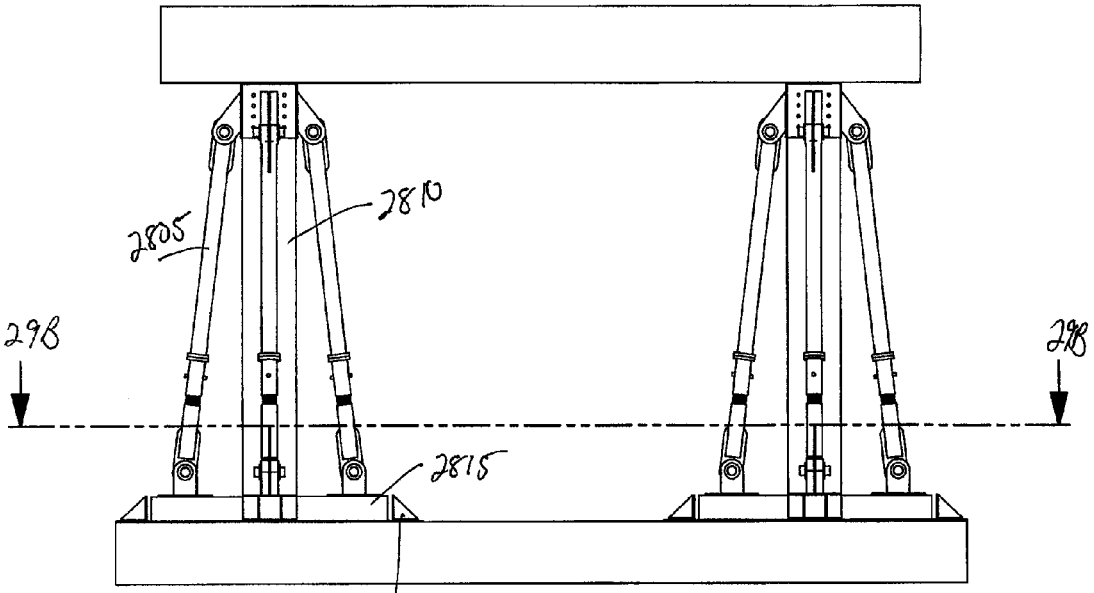
Figure 29B:
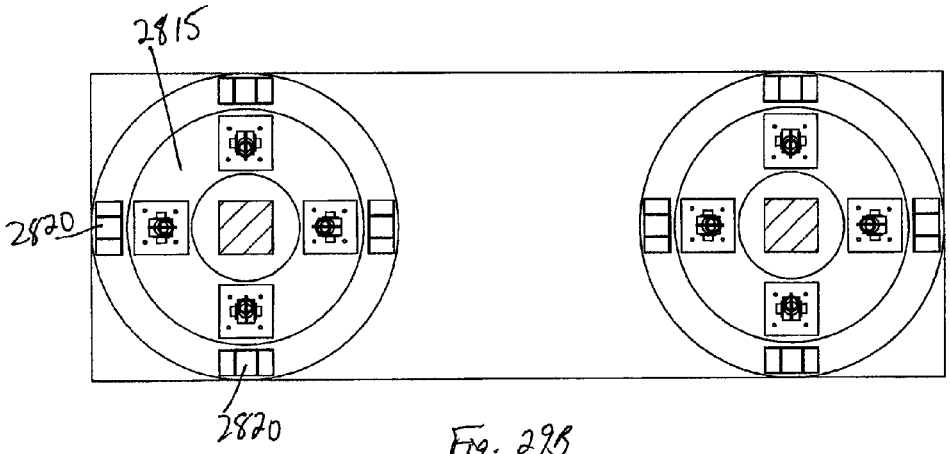

Referring also to FIGS. 24 and 25, there is shown an alternate of the previous embodiment, in which a plurality of braces 2405 are each pin connected to a single disc-shaped plate 2415. A gap exists between the disc-shaped plate 2415 and the ground, as is visible in FIG. 24. In this configuration, compressive forces are not transmitted along any of the braces 2405. However, during a seismic event, one or more of the braces will rotate about its respective pin joint, thus bringing the disc-shaped plate 2415 into contact with the ground and permitting the transmission of compressive forces along at least one of the braces 2405. Spherical elements 2407 may also be attached to the column 2410 to prevent the disc-shaped plate 2415 from contacting the column 2410. Disc-shaped plate 2415 is optionally convex curved on a bottom surface such that it touches the ground in the first configuration at a centre region thereof, but the outer regions of the plate 2415 only contact the ground in the second configuration, thus closing the gap and permitting the transmission of compressive forces along at least one of the braces 2405.

In another arrangement for generating the gab as shown in FIGS. 26A, 26B and 27A, 27B, the brace 2605 is a contiguous brace which is connected from the top of a column 2610, for example by way of pin joints as described above, with no fixed connection between the brace 2605 and the foundation. Each of the braces 2605 are connected by a ring 2615 to provide a set of three-dimensional gapped-inclined braces. Four spherical 2620 elements are connected to each face of the column 2610. A spatial distance is designed between the ring 2615 and the spherical elements 2620, which functions as the gap. Once the column 2610 deforms laterally or sways, the ring 2615 also moves laterally until it bears against one of the spherical elements 2620. Then, the ring 2615 slides until it bears against a respective spherical element 2620 resulting in rotation of one or more of the braces 2605 closer to vertical which permits the transmission of compressive forces along the braces 2605.

In one variation on the previously described embodiment, brace 2805 is a connected from the top of a column 2810, for example by way of pin joints as described above, with no fixed connection between the brace 2805 and the foundation. Each of the braces 2805 are connected by a ring 2815 to provide a set of three-dimensional gapped-inclined braces. Four (or more) stop elements 2820 are position spaced from the ring 2815. The ring 2815 is effectively floating, with the spatial horizontal distance between the ring 2815 and the stop elements 2820 forming the gap. Once the column 2810 deforms laterally or sways, the ring 2815 also moves laterally until it bears against one of the stop elements 2820. Then, the ring 2815 slides towards the respective stop element 2820 resulting in rotation of the braces 2805, which permits the transmission of forces along the braces 2805.

Various modifications and variations may be made to the invention as herein described. For example, the invention may be applied to building structures which are not strictly of the soft storey configuration. For example, the gapped-inclined brace could be used to support columns in other building configurations, or used to supplement soft storey configurations that have already been retrofitted using prior art arrangements or in new buildings purposely designed to form soft storeys. The invention is limited only by the claims which now follow. The scope of the claims should not be limited by the preferred embodiments set forth in the examples, but should be given the broadest interpretation consistent with the description as a whole.

The invention claimed is:

1. A building structure having at least one storey comprising:

at least one column;

at least one brace attached at one end to one side of at least one of said columns and at a second end to a fixed foundation surface; said brace attached to the at least one column at an incline;

said at least one brace having a first portion and a second portion;

wherein said at least one brace has a first in-use configuration in which the first portion is freely moveable with respect to the second portion such that a gap is formed in the brace preventing the transmission of force axially along the brace by preventing tensional forces from travelling axially along the brace, and a second in-use configuration in which the gap is closed by the first portion and the second portion being in contact to permit the transmission of forces axially along the brace;

and wherein said second in-use configuration allows compressive forces to be transmitted along the brace such that the brace is activated when sufficient deformation occurs in the column in a direction that compresses the brace.

2. The building structure according to claim 1, wherein said second portion comprises a tubular shape member and said first portion is sized and otherwise dimensioned to be slidable within the tubular shape member.

3. The building structure according to claim 2, wherein said second portion further comprises a stop portion upon which said first portion bears when the gap is closed.

4. The building structure according to claim 3, wherein said stop portion is formed by a reduced cross-sectional dimension of said tubular member.

5. The building structure according to claim 1, wherein said at least one brace is connected at the one end directly to said at least one column.

6. The building structure according to claim 1, wherein said at least one brace is connected to a beam at a position proximate to said at least one column.

7. The building structure according to claim 1, wherein the at least one brace is attached to the column and to the fixed foundation surface by pin joints.

8. The building structure according to claim 7, wherein the at least one brace is attached to the column using a bracket having a first end connected to said column and a second end offset from said column; said at least one brace attached to the second end with a pin joint.

9. The building structure according to claim 1, wherein one of said first and second portions includes an adjustment means for adjusting the length of one of said first and second portions.

10. The building structure according to claim 9, wherein said adjustment means comprises an axial length adjustment screw.

11. The building structure according to claim 1, wherein said at least one column comprises two outer columns.

12. The building structure according to claim 11, wherein said at least one brace comprises two braces supporting each of said columns; said two braces positioned on opposite sides of said columns.

13. The building structure according to claim 11, wherein said at least one brace comprises one brace supporting each of the columns and two braces supporting at least one internal column.

14. The building structure according to claim 1, further comprising a supplementary damping system for damping vibrations in the building structure.

15. The building structure according to claim 1, configured as a soft-storey structure.

16. A brace for use in supporting at least one column in a structure as the column undergoes deformation; the brace comprising:

a first portion and a second portion;

wherein the brace has a first in-use configuration in which the first portion is freely moveable with respect to the second portion such that a gap is formed in the brace preventing the transmission of force axially along the brace by preventing tensional forces from travelling axially along the brace, and a second in-use configuration in which the gap is closed by the first portion and the second portion being in contact to permit the transmission of forces axially along the brace, wherein said second in-use configuration allows compressive forces to be transmitted along the brace such that the brace is activated when sufficient deformation occurs in the column in a direction that compresses the brace.

17. The brace according to claim 16, wherein said second portion comprises a tubular member and said first portion is sized and otherwise dimensioned to be slidable within the tubular member.

18. The brace according to claim 17 wherein said second portion further comprises a stop portion upon which said first portion bears when the gap is closed.

19. The brace according to claim 18, wherein said stop portion is formed by a reduced cross-sectional dimension of said tubular member.

20. The brace according to claim 16, wherein one of said first and second portions includes an adjustment means for adjusting the length of one of said first and second portions.

21. The brace according to claim 20, wherein said adjustment means comprises an axial length adjustment screw.

22. A building structure having at least one storey comprising:

at least one column;

at least one brace attached at one end to one side of at least one of said columns;

said brace attached to the at least one column at an incline;

wherein said building structure has a first in-use configuration in which a gap is formed preventing the transmission of force axially along the brace, by preventing tensional forces from travelling axially along the brace and a second in-use configuration in which the gap is closed to permit the transmission of forces axially along the brace;

and wherein said second in-use configuration allows compressive forces to be transmitted along the brace such that the brace is activated when sufficient deformation occurs in the column in a direction that compresses the brace.

23. The building structure according to claim 22, further comprising a disc-shaped element connected perpendicularly to another end of said brace such that said disc-shaped element is positioned at a non-orthogonal angle to ground when said at least one brace is in said first configuration.

24. The building structure according to claim 23, further comprising a stop element positioned between said at least one column and said at least one brace such that said disc-shaped element bears against said stop element in said first configuration.

25. The building structure according to claim 22, further comprising a spherical element positioned on a face of said at least one column and a ring member located around said at least one column, such that an inner surface of said ring member is spaced from said spherical element in said first configuration;

said at least one brace connected at another end to said ring member;

wherein each of said at least one braces are connected via a pin joint to said ring member.

26. The building structure according to claim 22, further comprising a ring member located around said at least one column, such that an inner surface of said ring member is spaced from said column;

a stop member positioned axially away from an outer surface of said ring member such that the gap is formed between the outer surface of said ring member and an inner surface of said stop member in said first configuration;

said at least one brace connected at another end to said ring member;

wherein each of said at least one braces are connected via a pin joint to said ring member.

* * * * *